US012352061B2

(12) United States Patent
Jaycox et al.

(10) Patent No.: US 12,352,061 B2
(45) Date of Patent: Jul. 8, 2025

(54) SYSTEM AND METHOD FOR HYBRID BUILDING CONSTRUCTION FOR DIFFICULT SITES

(71) Applicant: Situ-Places, Inc., Santa Cruz, CA (US)

(72) Inventors: Stephen W Jaycox, San Francisco, CA (US); Quentin Topping, Santa Cruz, CA (US)

(73) Assignee: Situ-Places, Inc., Santa Cruz, CA (US)

( * ) Notice: Subject to any disclaimer, the term of this patent is extended or adjusted under 35 U.S.C. 154(b) by 248 days.

(21) Appl. No.: 17/830,182

(22) Filed: Jun. 1, 2022

(65) Prior Publication Data

US 2022/0381050 A1 Dec. 1, 2022

Related U.S. Application Data

(60) Provisional application No. 63/195,614, filed on Jun. 1, 2021.

(51) Int. Cl.
*E04H 1/00* (2006.01)
*E04B 1/348* (2006.01)

(52) U.S. Cl.
CPC ..... *E04H 1/005* (2013.01); *E04B 1/34861* (2013.01); *E04B 1/34869* (2013.01)

(58) Field of Classification Search
CPC ..... E04H 1/005; E04H 1/12; E04B 1/34861; E04B 1/34869; E04B 1/34807;
(Continued)

(56) References Cited

U.S. PATENT DOCUMENTS 3,514,910 A 6/1970 Comm
3,634,985 A * 1/1972 Tipton ..... E04B 1/343 52/64

(Continued)

OTHER PUBLICATIONS

PCT/US22/031831 Notification of Transmittal of the International Search Report and the written Opinion of the International searching Authority, or the Declaration. Sep. 15, 2022.

(Continued)

*Primary Examiner* — Gisele D Ford
(74) *Attorney, Agent, or Firm* — Dergosits & Noah LLP; Michael E. Dergosits

(57) ABSTRACT

A building apparatus, system, and method are disclosed in which a structural core, with a minimal footprint, provide the backbone for building units that are multiples of the size of the footprint of the structural core with minimal additional support. Such units may be combined repeatedly and in various orientations to create more complex systems. The design, configuration, and assembly process disclosed is for a composite structural system that achieves an occupiable space capture through the use of a small footprint 3-D structural box frame that is strong enough to provide the shear strength for multiples of the depth of the frame base from a foundation anchorage merely equal to the size of the structural box frame base. Thus, each structural box frame solves for its own structural performance, or a combination of structural box frames may combine to solve for the combined structural performance. This strategy reduces the structural footprint relative to total occupiable space capture and reduces the number of building parts required to achieve occupiable space capture, which accelerates and simplifies builds, and reduces the staging area demands of construction.

24 Claims, 23 Drawing Sheets

(58) Field of Classification Search
CPC ..... E04B 1/34815; E04B 1/24; E04B 1/34; E04B 1/343
See application file for complete search history.

(56) References Cited

U.S. PATENT DOCUMENTS

| | | | | |
|---|---|---|---|---|
| 3,716,954 | A | 2/1973 | Kelbish | |
| 3,721,056 | A * | 3/1973 | Toan | E04H 1/04 52/79.12 |
| 5,239,798 | A | 8/1993 | Saito | |
| 5,797,227 | A | 8/1998 | Garza-Tamez | |
| 8,621,818 | B1 | 1/2014 | Glenn et al. | |
| 8,943,759 | B2 | 2/2015 | Warner et al. | |
| 9,085,901 | B2 | 7/2015 | Mueller | |
| 9,121,168 | B2 | 9/2015 | Levy et al. | |
| 9,441,359 | B1 | 9/2016 | Hsieh | |
| 10,837,168 | B2 | 11/2020 | Rittmanic | |
| 11,619,556 | B1 | 4/2023 | Chen et al. | |
| 2011/0214361 | A1* | 9/2011 | Ingjaldsdottir | E04B 1/3483 52/745.13 |
| 2013/0239487 | A1* | 9/2013 | Ingjaldsdottir | E04B 2/30 52/79.1 |
| 2014/0059947 | A1 | 3/2014 | Rothwell et al. | |
| 2014/0115976 | A1* | 5/2014 | Lippert | E04H 1/005 52/79.2 |
| 2014/0123572 | A1* | 5/2014 | Segall | G09B 9/003 52/79.5 |
| 2015/0247316 | A1* | 9/2015 | Coupe | E04B 1/34384 52/655.1 |
| 2018/0355600 | A1* | 12/2018 | Yang | E04B 5/10 |
| 2020/0131761 | A1 | 4/2020 | Markman et al. | |
| 2020/0149266 | A1 | 5/2020 | Griechen et al. | |
| 2021/0372074 | A1 | 12/2021 | Hodge | |
| 2021/0395042 | A1* | 12/2021 | Collins | E04F 11/18 |
| 2023/0145279 | A1* | 5/2023 | Snorrason | E04B 1/34861 52/79.1 |

OTHER PUBLICATIONS

Connect Home Series Brochure—downloaded Aug. 9, 2022—publication date unknown.

Screen Capture from the web site at URL https://blueskybuildingsystems.com/offerings, created by others, as the web bage appeared on May 29, 2021.

International Search Report and Written Opinion from International Patent Application No. PCT/US24/26350, dated Aug. 14, 2024.

* cited by examiner

SYSTEM AND METHOD FOR HYBRID BUILDING CONSTRUCTION FOR DIFFICULT SITES

CROSS-REFERENCE TO RELATED CASES

This application claims priority to U.S. Provisional Patent Application No. 63/195,614, entitled "System and Method for Hybrid Building Construction for Difficult Sites," filed Jun. 1, 2021, which is hereby incorporated by reference in its entirety.

BACKGROUND

Today there are two prevailing modes of construction for small-to-medium format buildings for residential and commercial use: (1) Site-built Construction and (2) Pre-fabricated Installations. The first mode, custom Site-built Construction, is, a strategy that provides a great deal of flexibility for customization in both plan arrangement and building envelope to best exploit structure-to-site relationships and views. However, this type of construction strategy can be costly and inefficient with respect to time because it requires the majority of material handling and staging be done at the build site and generally requires generous vegetation clearance and grading. The second mode, Pre-fabricated Installation, may be a more time efficient construction strategy than Site-built Construction, but it also generally requires a build site to be cleared and graded. The second mode, Pre-fabricated Installation, locates the majority of the assembly in a controlled environment but typically requires that the volumetric modules produced be certified as a "manufactured building," thus rendering the outcome subject to different building codes and idiosyncratic requirements that do not necessarily relieve the obligation to generously clear and grade the installation site. Additionally, Pre-fabricated Installation very often limits the ability to customize the structure to best suit structure-to site relationships and views due to the pre-fabrication method's system logic. In sum, the first mode, Site-built Construction, can be cost efficient and flexible, but not time efficient. The second, Pre-fabricated Installation, can be time efficient and provide better build quality, but is not cost efficient or flexible. Neither mode, inherently, solves for unlocking the economic potential of difficult build sites, nor do they solve for minimizing site impact such as disturbance though vegetation clearance, grading or even outright site leveling.

BRIEF DESCRIPTION OF THE DRAWINGS

The embodiments are illustrated by way of example and not limitation in the accompanying drawings, in which like references indicate similar elements, and in which.

DETAILED DESCRIPTION

Figure 1:
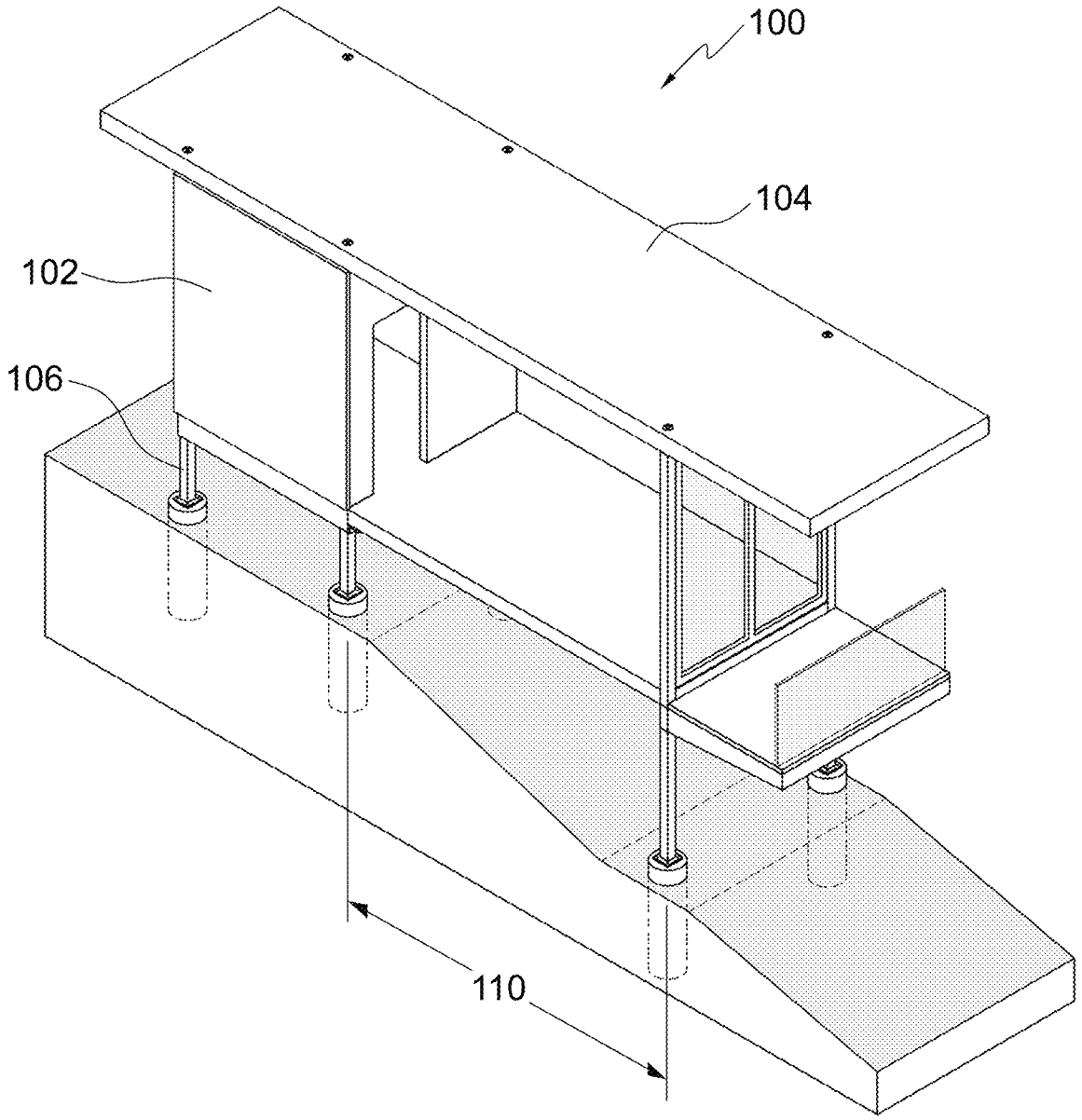
FIG. 1 illustrates an embodiment of a Universal Architectural System (UAS) unit comprising both modular elements and flat pack elements assembled into the minimum (core) building block module.

The presently claimed invention describes a Universal Architectural System (UAS) which is a highly-efficient, structurally-tuned building system that utilizes a novel hybridization of modular construction and flat pack construction methodologies to achieve a UAS "unit" or building that can be combined with like "units" in a variety of ways to create a wide range of possible building layouts and scales.

The UAS unit's design is made up of an assembly of bespoke and customized parts that involve unique assembly strategies and connects to yield a cross-sectional building envelope that can be erected on any prepared site (even ones with difficult topography) in a single day.

The speed of site assembly is made possible through a novel hybridization of a modular construction and a flat pack construction methodology that exploit the structural combination of a core structural element with projecting roof and floor elements to yield a system that avoids inefficient extremes in the use of materials while maximizing column free interior space capture.

In particular, the UAS provides a novel approach to product design, engineering and the development of means and methods for production and site installation of a UAS unit or units. This novel approach yields construction of small-to-medium format buildings, relevant to both residential and commercial use, at a cost scale that specifically honors the development preforms common to this scale and type of development. It does so through a production model that is a novel hybridization of Site-built and Pre-fabricated methodologies (involving a discerning use of both modular and flat pack elements) in such a way as to produce a built outcome that is able to receive conventional site-built permits, inspections and approvals (from a governmental planning and building department authority), while simultaneously achieving the labor efficiency of pre-fabricated construction by locating the majority of the pre-inspection trade integration of mechanical, electrical and plumbing systems in a controlled off-site environment. The outcome achieves the customization and site-fit flexibility of Site-built Construction and the build quality of Pre-fabricated Installation.

The value of this novel approach to the production of small-to-medium format buildings are numerous and are described in detailed qualitative and quantitative arguments below. For example, the UAS is a viable solution for difficult build sites, which the prevailing modes of construction, site-built construction or pre-fabricated construction, imperfectly address either due to limitations on ability to prepare a site for construction or due to logistical difficulties posed by the transport and installation of inflexibly sized building components. Thus, the UAS construction method unlocks the possibility of constructing buildings on sites which would otherwise be cost prohibitive through conventional means.

Further, the UAS has been intentionally designed, and is thus well-suited, to the needs of multiple building typology verticals (such as, but not limited to: hospitality, hospitality branded residence, vacation home, primary residence, commercial space, office space, co-working space, equitable housing and even spaces for education or training) that require a building system that has been designed for variation in scale and envelope arrangement, minimal structural interruption in usable/occupiable space and the possibility of reversible construction and subsequent reuse of system parts, i.e., module 102 and flat pack 104 elements may be disassembled and reused. In contrast, traditional construction methods essentially require the destruction of a completed building to reuse elements of the building.

The consumer benefits of the built outcomes of the UAS include the minimization of disruption to the natural ecology of building sites through the design of a system ideally suited to installation on pier foundations, creating a marketplace alternative the common practice of extensive site grading and replacement of removed site vegetation with non-native species which require more water to start, and maintain, than native species. Further and related, the structural logic of the UAS's engineered building system solves for the minimization of the footprint of load-bearing structure, both at the foundation level and in the envelope of occupiable space. This results in an outcome that allows generous flexibility in the quantity and location of windows and doors to maximize the indoor/outdoor experience of resulting structures. Construction per the novel product design, engineering and developed means and methods for production and installation of the UAS, results in a specific aesthetic outcome, characterized by generously sized fixed windows and sliding glass doors that delivers an immersive natural experience for the structure's occupants. This aesthetic outcome, in combination with the tactical advantages of the site installation of the building system, well positions the built result relative to multiple building market verticals that would value, and potentially even assign a premium, to the aesthetic and experiential character of the buildings the UAS is able to produce.

FIG. 1 illustrates an embodiment of a Universal Architectural System (UAS) unit comprising both modular elements and flat pack elements assembled into the minimum (core) building block module. In FIG. 1, a UAS unit 100 may be described as including a structural module 102 and elements of a flat, pack 104, both described in more detail with reference to FIG. 2A-2C). Unit 100 may be supplied with a foundation including columns 106, which may optionally include telescoping elements. Site 108 is shown to be undeveloped, other than for holes or pads as required for columns 106. A span 110 indicates a distance between core 102 and a moment frame 242 (FIG. 2A) which is alterable to best suit site conditions. For example, span 110 may be freely altered without incurring manufacturing premiums, since, e.g., the lengths of only floor 232 and ceiling 230 need be changed to accommodate the change.

Figure 2A:
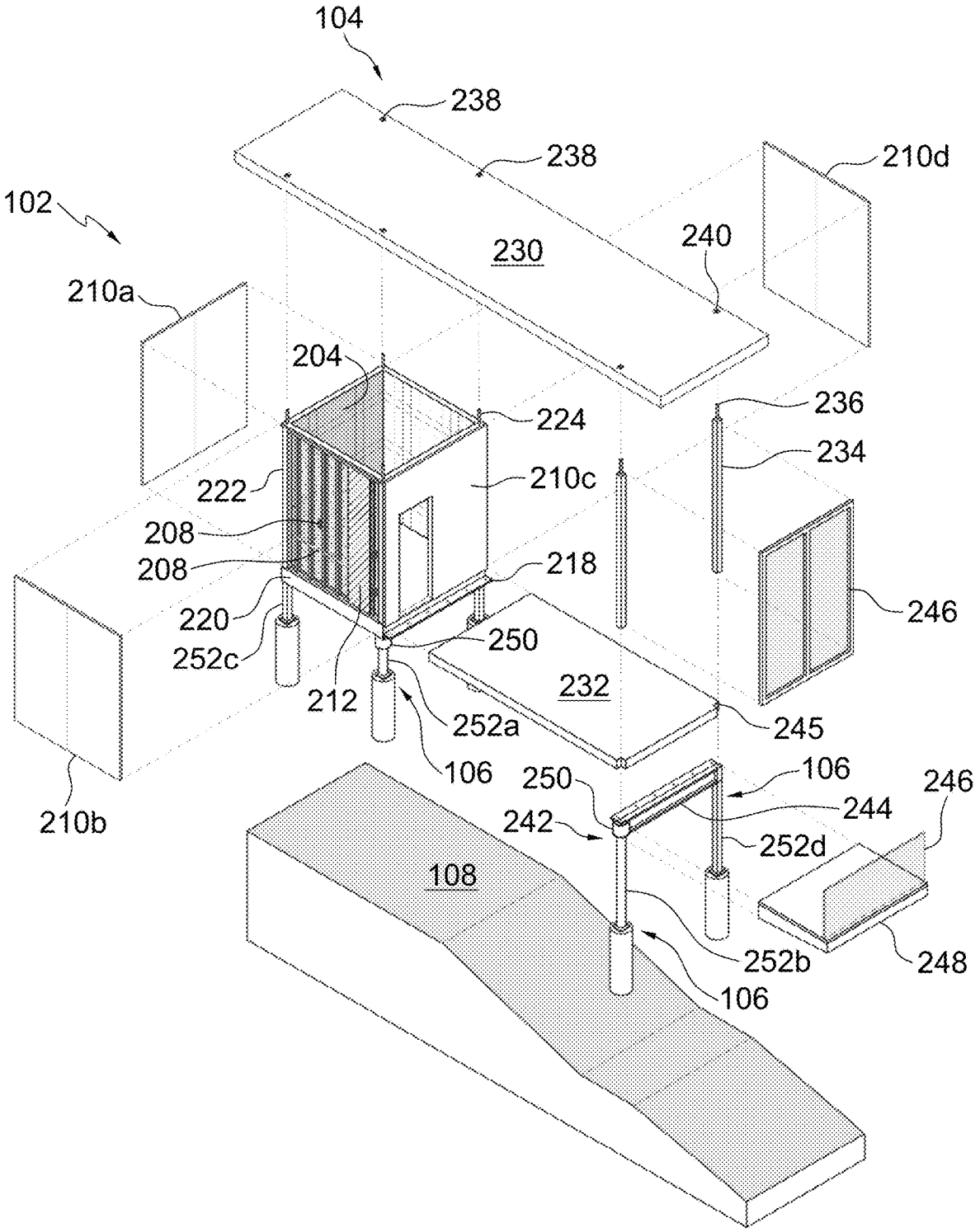
FIG. 2A illustrates the distributed nature of an embodiment of the UAS and identifies the component parts of the system, distinguishing between designed elements and sourced products.
Figure 2B:
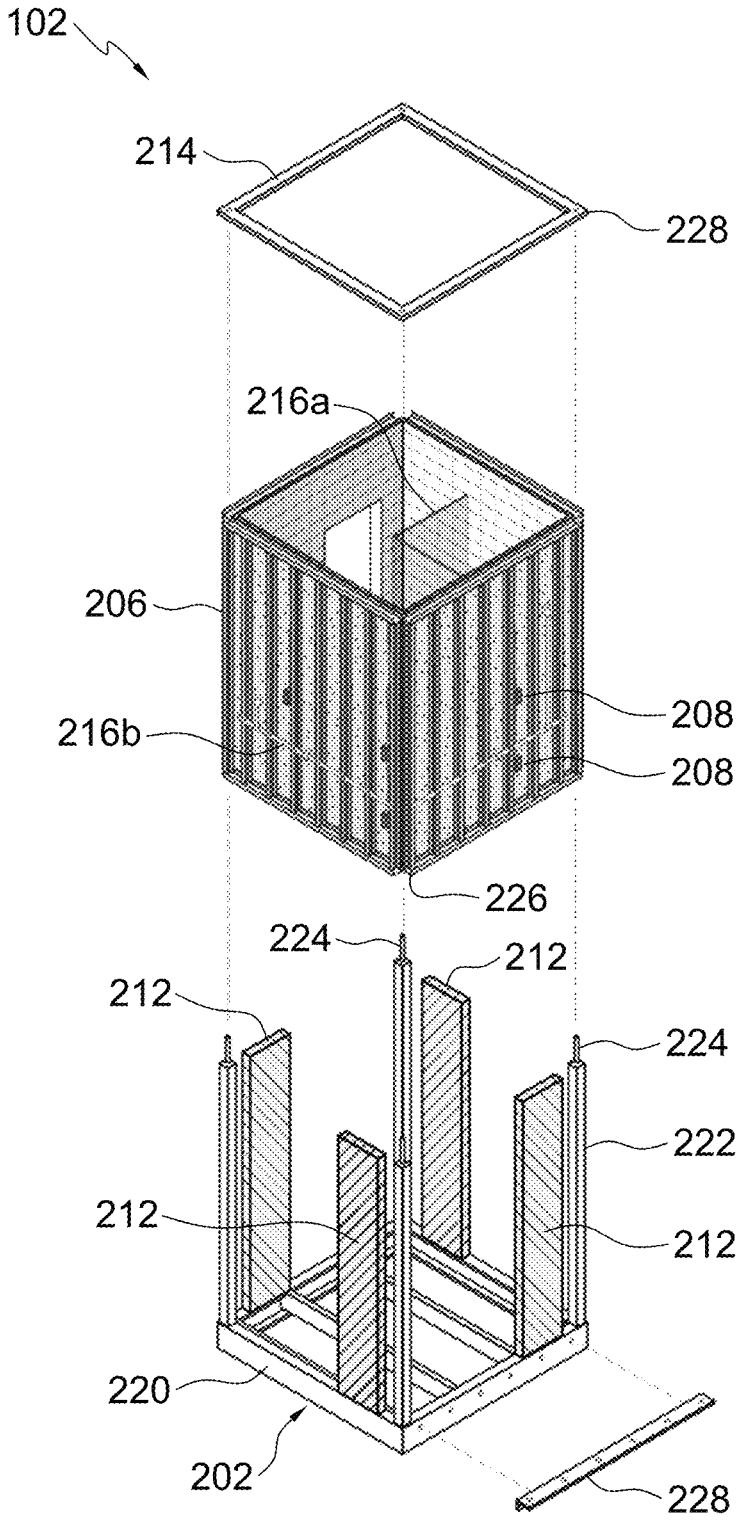
FIG. 2B illustrates the distributed nature of an embodiment of the UAS and identifies the component pans of the system, distinguishing between designed elements and sourced products.

FIG. 1 illustrates UAS unit 100 comprising both the volumetric elements of module 102 and flat pack elements 104, such as ceiling 230 (FIG. 2A) and floor 232 (FIG. 2B). Module 102 acts as both the structural and programmatic core of UAS unit 100. As steel construction. Module 102 provides both support and ballast for each UAS unit 100 at once, while simultaneously delivering the structure's shear control in a concentrated package. Further, this structural core, module 102, is universally sized to accommodate the common trade-intensive features of a building program such as kitchen, bath, utility, laundry, housekeeping, building systems and storage spaces, allowing mechanical, electrical, and plumbing (MEP) trades to complete the installation work in a controlled factory environment while still delivering to site 108 what may be characterized as a conventional architectural build and not a pre-manufactured building.

Flat pack elements 104 complete the build of UAS unit 100 and can be executed in a variety of offset depths to yield column free interior space for the highest degree of flexibility for architectural program assignment, interior partitions, in this building scenario, do not need to be load-bearing, thus allowing interior wall build-out to be completed in any seasonal weather condition.

The advantages of UAS unit 100, comprising a unified structural design solution involving both volumetric elements of module 102 and flat pack elements 104, is a novel building strategy in that the unit size is neither defined by, nor is limited in scale to standard truck bed/transit constraints. The redundant structure (duplicated columns) inherent in conventional manufactured and/or modular pre-fabricated construction, is avoided and the number of parts necessary to complete a built outcome is substantially reduced to yield a robust and flexible outcome, whose structural elements are right-sized and proportional to the required structural performance of the building.

Figure 2C:
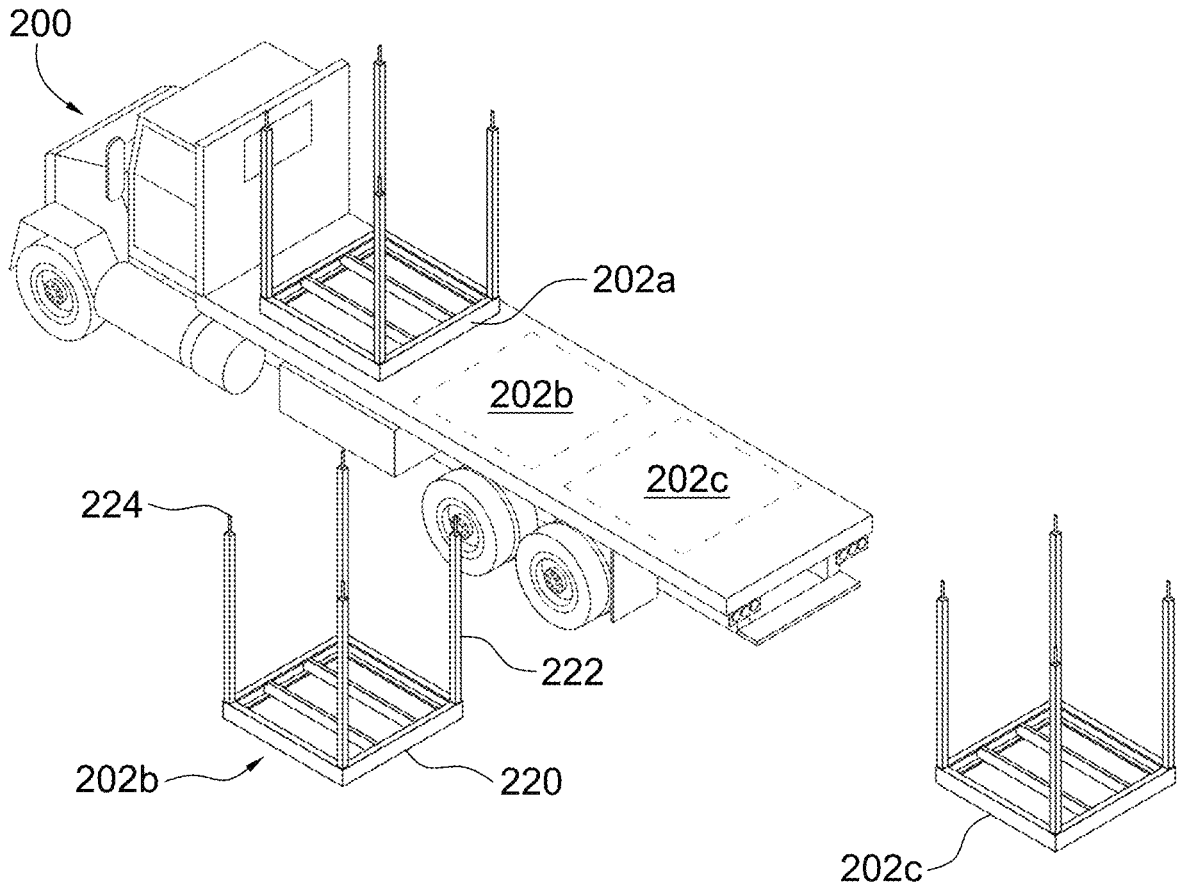
FIG. 2C illustrates the distributed nature of an embodiment of the UAS and identifies the component parts of the system, distinguishing between designed elements and sourced products.

FIGS. 2A-2C illustrate the distributed nature of an embodiment, of the UAS and identify the component parts of the system. FIG. 2A illustrates an embodiment of a kit for unit 100 that may be delivered to destination site 10B for assembly and inspection A kit for module 102 includes a volumetric steel structure 202 (FIG. 2C), including a base frame 220 and columns 222. The kit further includes a program insert 204 (a type of interior assembly), which includes an insert frame 206 and additional elements 20B, such as electrical 216*b* (FIG. 2B), mechanical, or plumbing elements 216*a* (FIG. 2B), and a number of shear panels 212 (such as a Strong-Wall®), which provide module 102 with shear strength. When assembled, shear panels 212 may connect between an alignment frame 214 (FIG. 2B, a type of upper frame) and base frame 220, such that no additional structure directed to providing shear strength need be placed between the roof 230 and floor 232. The kit further includes demountable shipping panels 210*a* . . . 210*d* (a type of exterior wall). Columns 222 include threaded fasteners 236, which secure alignment ring 214 through holes 223 and also secure ceiling 230 to module 102 through holes 238. In addition to nuts securing ceiling 230 to fasteners 224 (e.g., a threaded rod), nuts may be applied to secure alignment ring, below ceiling 230. In an embodiment, the shear transfer between modules 102, whether side-to-side, or in other possible configurations, occurs at the level of the floor 232 where the units 100 are structurally unified by their connections to the column plates 2204 (FIG. 22A, FIG. 22B), column top receptacles 250 (FIG. 23) and moment frame 242 connections. At the roofline of the system, the CLT panels 230 are connected with steel linear mending plates bolted or timber-riveted to the CLT material to achieve total building diaphragm equal to the area of the ceiling covered area. For example, ceilings 230*a*, 230*b* (FIG. 7) could be joined using such a steel linear mending plate to achieve a total building diaphragm equal to their combined areas. Therefore in combination, at the kit-level, these design decisions optimize structural efficiency relative to material sizing and allow for the elimination of unproductive redundancies that would otherwise add material and labor cost to the build.

The kit for flat, pack 104 includes ceiling 230, floor 232, a ledger 218 (a type of flange). Further elements of a flat pack kit include a glazing system 246 (e.g., window elements), a balcony 248, and a disassembled moment frame 242. Moment frame 242 itself includes a cross bar 244, a pair of columns 234, and a pair of columns 106. Similarly, ceiling 230 is bolted to moment frame 242 with threaded fasteners 236 passed through holes 240. Floor 232 may include recesses 245 to adapt to columns 234. Insert frame 206 may include recesses 226 to adapt to columns 222. Ceiling 230 and floor 232 may be constructed of Cross-Laminated Timber (CLT).

Regarding moment frame 242, an ad vantage of locating cross bar 244 below the line of floor 232 is that it allows for an upward view out the windows to follow the line of the ceiling as it transitions to the underside of roof overhang without obstacle. Should a cross bar be located immediately beneath ceiling 230, it would partially obstruct this view. The advantage provided by the lower location of cross bar 244 reduces the perception of "containment" in the space and provides unit 100 with a seamless indoor/outdoor experience.

Regarding ledger 218, in embodiments, a ledger 218 may be attached to any and all sides of module 102, e.g., at base frame 220. This provides module 102 with the flexibility to be positioned variously, e.g., on an edge condition, a centered condition, or a corner condition, with, floors attached thusly.

In an embodiment, one or more of the components of a UAS unit may be outsourced, e.g., strong wall 212, CLT ceiling panel 230, CLT floor panel, 232, and glazing system 246.

In an embodiment, shear panels 212 may bolted at top to alignment frame 214 and at bottom to base frame 220. Alignment frame 214 and roof 230 may both be bolted to columns 222 using the same fasteners 224 (e.g., a threaded rod), with a first nut securing alignment frame 214 and a second nut securing roof 230. Program insert 204 may be inserted into frame 220 before shear panels 212 and alignment frame are attached and module 102 shipped complete with program insert 204, or program insert 204 may be assembled into frame 220 after shear panels 212 and alignment frame 214 have been attached, e.g., on-site.

In embodiments, upper sections of columns 106 may be square 252*c*, 252*d*, or round 252*a*, 252*b*. In an embodiment, steel structure 202 and moment frame 242 may be provided with a receptacle 250 (described further with respect to FIG. 23) configured to accept and retain a domed insert 2302 (FIG. 23) atop sections 252*a*, 252*b* of columns 106. Two instances of receptacle 250 are shown in FIG. 2A, but it should be understood that each center of base frame 220 and end of moment frame 242 may be so equipped. In embodiments, a receptacle 250 may be atop a square column 252*c*, 252*d*, as well as a round column 252*a*, 252*b*.

In embodiments, alignment frame 214 serves is to keep the top of each column 232 (and its threaded fastener 224 for connection to frame 214 and ceiling 230) in a true square configuration during, shipment, handling, site manipulation and, finally, the installation of ceiling 230 with its pre-drilled holes 238 to receive the corner column's threaded rods. In an embodiment, module 102 may be shipped to the site with alignment frame 214 installed. In such embodiments, the tops of shear panels 212 are connected to alignment frame 214 during shipping as well, which keeps them in alignment as well.

FIG. 2B illustrates the assembly of structure steel box module 102 and program insert 204. Program insert 204 may be built within steel structure 202 at the UAS fabrication facility or at the construction site.

FIGS. 2A and 2B illustrate the benefits of the UAS over conventional construction. UAS unit 102 has demountable exterior wall panels 210 that allow the UAS to be inspected from the outside in in order to increase production speed. Specifically, the UAS inverts the "inspection space" from interior to exterior so that volumetric elements, modules 102, can be delivered to the site with full trade integration and interiors complete, i.e., program inserts 204 already installed, gaining up to 25% in labor efficiencies. Site inspections are made from exterior of the UAS unit through the use of demountable panels 210, eliminating the gate-checking consequences of inspections and substantially reducing overall implementation time.

In contrast, a gate-checked inspection process of a conventional construction occurs substantially on the interior of the structure. The conventional construction requires multiple trade-specific building inspections that gate-check the serial production of a build process. Because these inspections occur substantially on the interior of the space, a single inspection failure can result in significant completion delays due to sequence dependencies.

FIG. 2C illustrates that structural steel boxes 202*a* . . . 202*c* may be fabricated to specification and delivered, efficiently packed aboard a single transport 200.

FIGS. 3-9 illustrate the various intended and realistic quantitative benefits of the UAS. The narratives for each of the FIGS. 3-9 illustrate the various benefits of the UAS when compared to conventional means of construction/installation of buildings.

Figure 3:
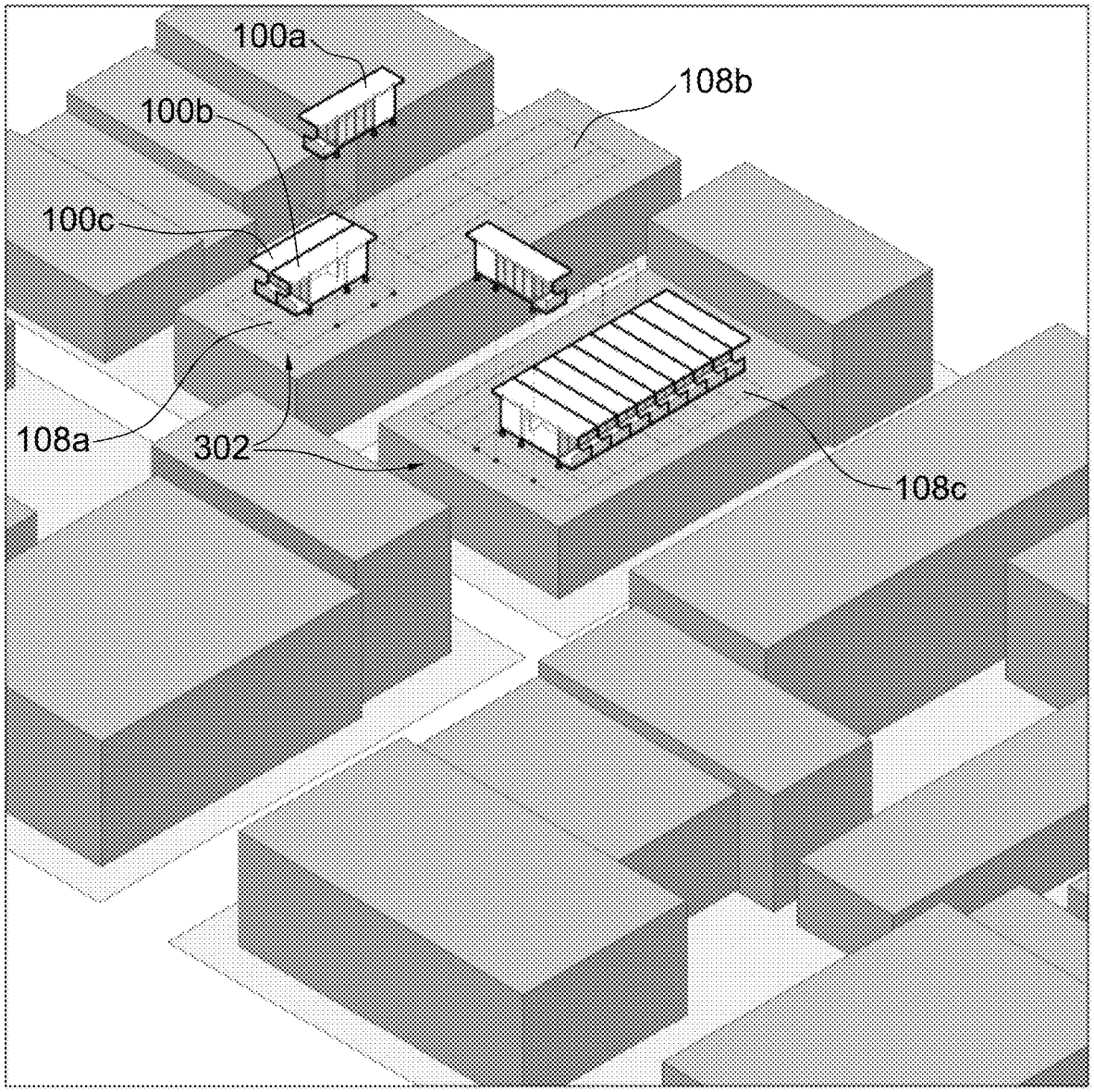
FIG. 3 illustrates an example of an embodiment of the UAS's ability to be executed on sites which are complicated by occupancy or density.

FIG. 3 illustrates an example of the UAS's ability to be executed on sites that are complicated by occupancy or density. UAS units 100*a* . . . 100*c* can be installed quickly on qualified building rooftops 108*b*, 108*c* to increase density and value in fully built contexts. FIG. 3 illustrates units 100*a* . . . 100*c* in a parallel configuration 302.

Installation of UAS units on rooftops may result in an increase of property value, community property tax benefits, and greater transit hub density, without disruptive demolition and new ground-up building replacements.

Figure 8A:
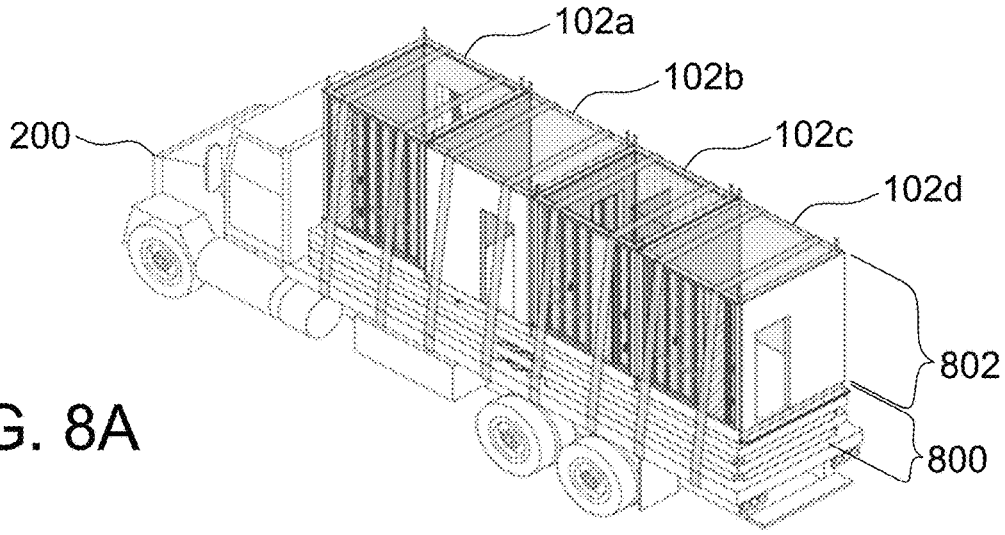
FIGS. 8A and 8B illustrate the truck bed delivery volume relative space capture advantage of an embodiment of the UAS and the UAS's ability to be executed on sites with difficult topography.
Figure 8B:
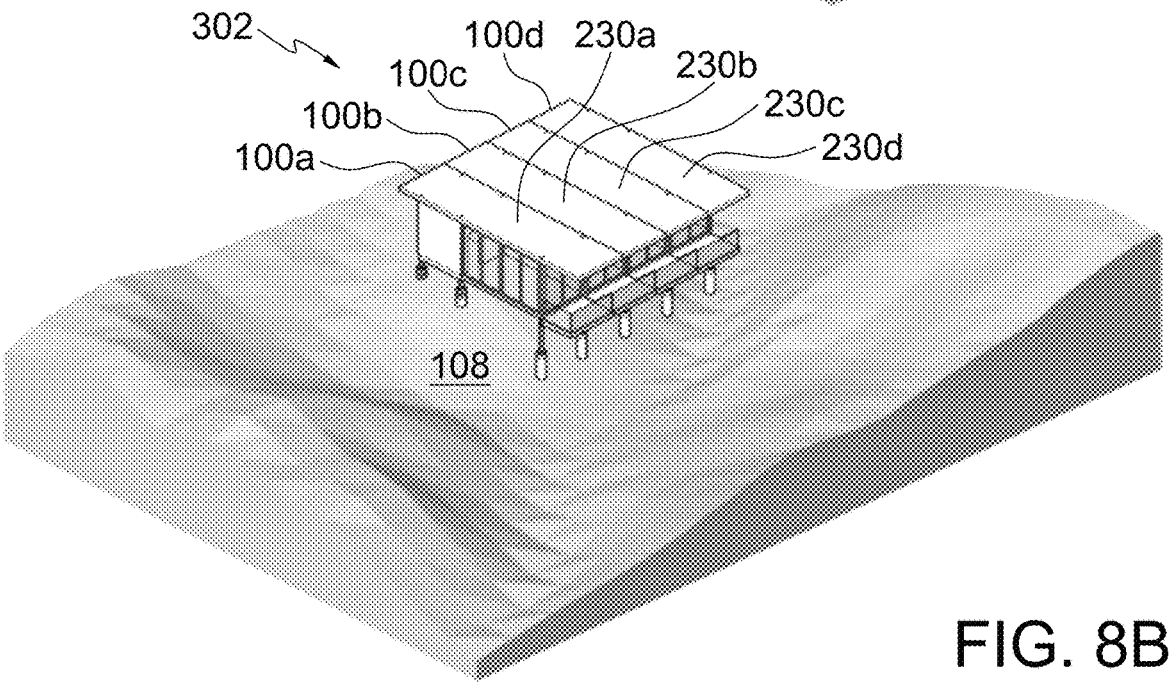

FIG. 8B illustrates an example of the UAS's ability to be executed on sites with difficult topography. In FIG. 8B, site 108 is undisturbed except for the work needed to prepare the foundation, e.g., columns 106. UAS unit/units 100*a* . . . 100*d* being built on sites 108 with difficult topography unlocks new value in undeveloped, and/or previously undevelopable, sites. The UAS unit 100 is a horizontally self-registering system that tolerates reduced precision in the work needed to set up foundation geometry for a site 108 with difficult topography. In other words, the UAS units can be built and joined on sites that would otherwise be cost prohibitive due to topographic constraints (via calibrated foundations, and self-registering construction), unlocking new value sites with challenging topography. For example, the construction of the UAS unit involves highly choreographed site implementation via crane assembly. As described below, crane assembly allows for UAS units to be built on previously undeveloped sites that have a difficult topography because the crane assembly requires only a minimal footprint thus reducing site clearance and regrading to up to 86%.

Figure 4:
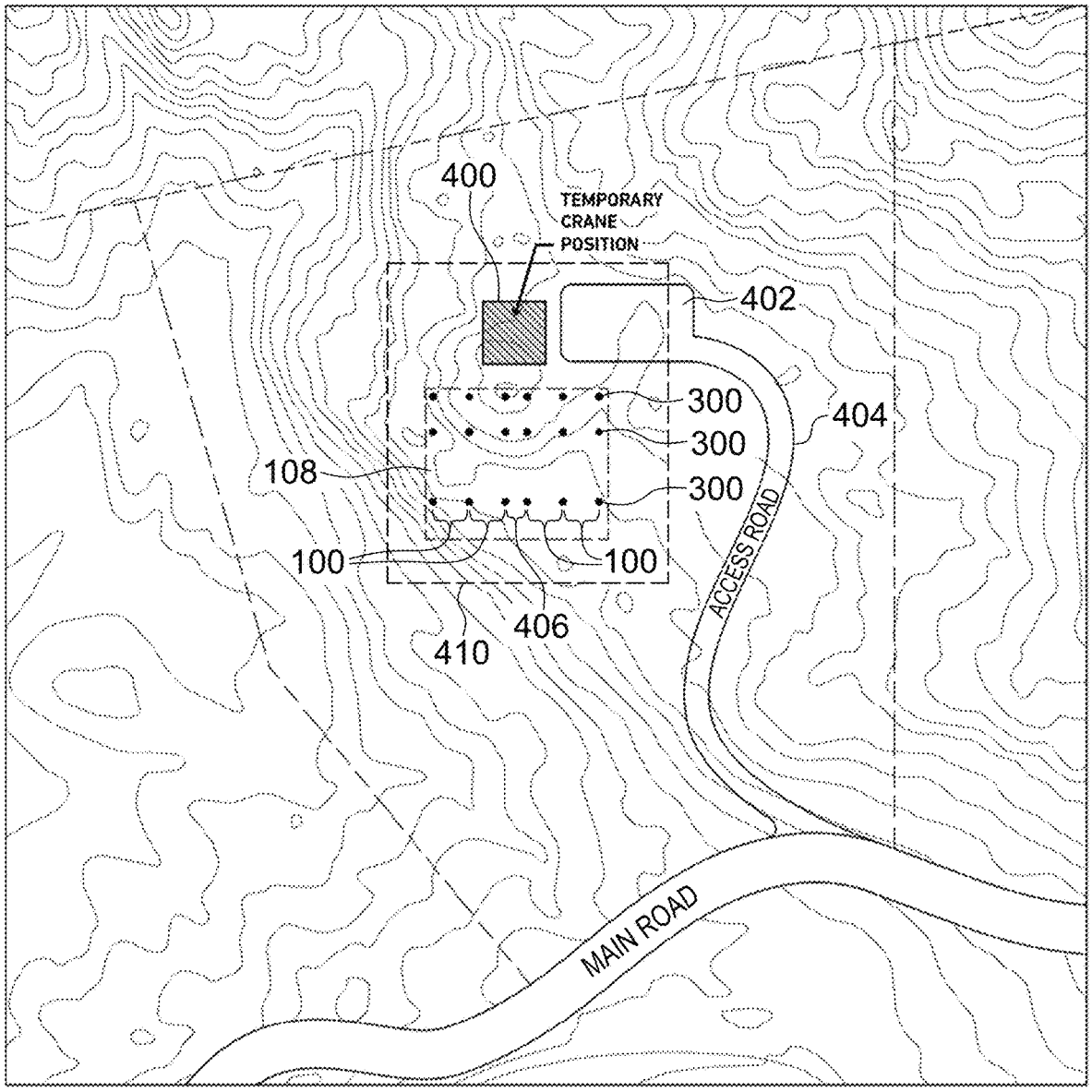
FIG. 4 illustrates a highly choreographed site Implementation of an embodiment of the UAS via a crane and the minimization of required site clearance on sites which are complicated by topography or natural obstacles.
Figure 5:
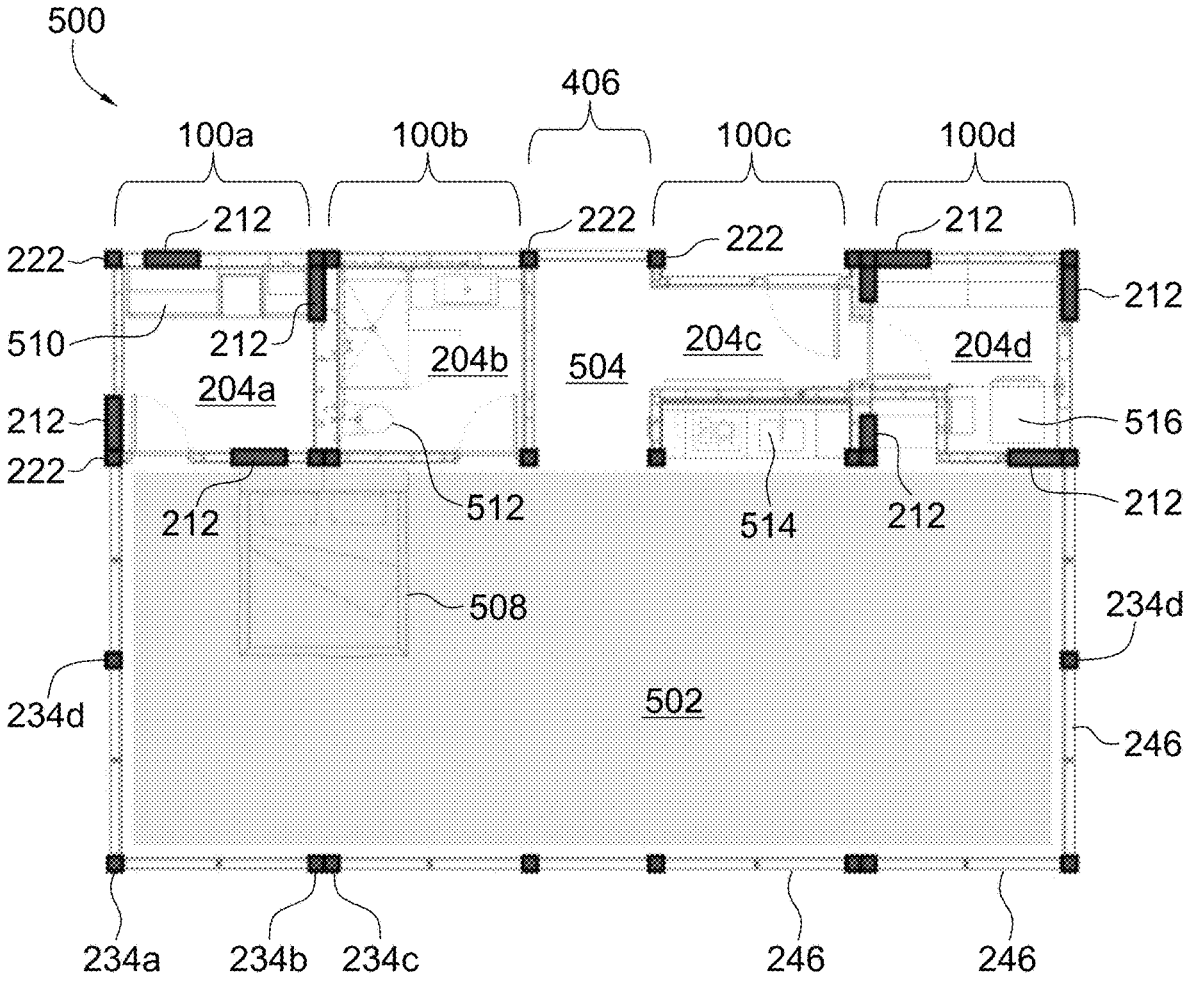
FIG. 5 illustrates the reduced vertical structure footprint of an embodiment of a UAS build due to its integrative systems engineering.

FIG. 4 illustrates a highly choreographed site implementation of an embodiment of the UAS via a crane and the minimization of required site clearance. In FIG. 4, a crane position 400 illustrates the single placement necessary to install multiple units 100 and an interstitial unit 406. It should be noted that site 108 of FIG. 5 is not graded, requiring preparation only by the addition of column foundation holes or pads 300. Parking 402 and access road 404 would generally be expected for any similar development.

FIG. 4 illustrates the benefit of the UAS over conventional construction build sites. The UAS provides a highly choreographed site implementation via a crane and the minimization of required site clearance. For example, because the UAS involves highly choreographed site implementation via crane assembly, the needed site clearance and re-grading of the site is reduced up to 86%, resulting in the preservation of a build sites natural ecology, watershed and aesthetic character.

In contrast to FIG. 4, a conventional construction build site typically requires an area of site to be cleared and leveled, illustrated by an outline of a potential building site to be cleared and leveled 410. The conventional builds require extensive site clearance and grading for foundation implementation, construction staging and building trades access. The site clearance and grading required drives up the cost in development of new sites, may be restricted by local building authorities and has the potential to substantially disrupts the surrounding ecology of the build site.

FIG. 5 illustrates the reduced vertical structure footprint of an embodiment of a UAS build due to its integrative systems engineering. In FIG. 5, units 100*a* . . . 100*d* and interstitial unit 406 have been assembled to create a single structure 500, each running the length of structure 500. As a result, structure 500 includes an enlarged interior space 502, accommodating, e.g., a bed 508. Interstitial unit 406 provides a hallway 504 that itself provides access to interior assembly 204*c* and the entry. Other examples of interior assemblies 204 include an interior assembly 204*a*, which includes a closet 510, an interior assembly 204*b*, which includes a bathroom 512, interior assembly 204*c*, which includes a kitchen 514, and an interior assembly 204*d*, which includes a desk 516.

It should be noted that units 100*b* and 100*c* lack a shear structure, with the shear strength of the entire structure being provided by shear panels 212 within units 110*a*, 100*d*, As shown, four panels 212 are oriented in line with the upper edge of the structure and four panels 212 are oriented perpendicularly to that edge, the eight panels 212 providing the shear strength for the entire interconnected structure.

FIG. 5 illustrates the benefits of the UAS over conventional construction. The UAS build reduces vertical structure footprint due to its integrative systems engineering. The constructed UAS unit provides a structure that is designed to provide an open concept interior design 502 that is not hindered by intrusive support structures that are part of conventional Site-built construction and Pre-fabricated installation. Both of these prevailing practices rely substantially on wall and column-based structure to solve roof support issues and shear control. The result of using interstitial walls and columns as support generates an overly determinant and inflexible floor plan. The UAS unit reduces vertical structure footprint by up to 64%, liberating interior space to be substantially column free and flexible to accommodate a variety of architectural programs. In particular, the roof structure, ceiling 230, of UAS unit 100 maybe supported on one end by its volumetric steel structural core, module 102, and on the other end by moment frame 242, allowing for the interior portion of the UAS unit to be free of supporting walls or beams. In an embodiment, the roof structure, ceiling 230, of the UAS unit may be supported by its volumetric steel structural core in a cantilever fashion, allowing for the interior portion of the UAS unit, span 110, to be free of supporting walls or beams. In such a cantilevered embodiment, moment frame 242 functions to support floor 232 and perfect building diaphragm, i.e., the span of connected ceilings 230. The cantilevered ceiling 230 is not supported by the gravity columns 234. Rather, in the cantilevered embodiment, columns 234 limit deflection of ceiling 230, so, e.g., a seismic event does not cause the "diving board" of the roof to deflect and crush the glass below. Thus, in a cantilevered embodiment, columns 234 limit deflection of ceiling 230, performing a service to the overall structural integrity and maintaining the bolt-together nature of moment frame 242, floor 232, and ceiling 230. As discussed in this application, the length of the cantilever element includes the entire length of ceiling 230, including the section above module 102.

In contrast to the embodiment of FIG. 5, a vertical structure footprint in a conventional framed or prefabricated paneled construction execution relics substantially on wall and column based structures to solve for roof support and shear control. This results in overly determinant and inflexible floor plan arrangements.

Figure 6:
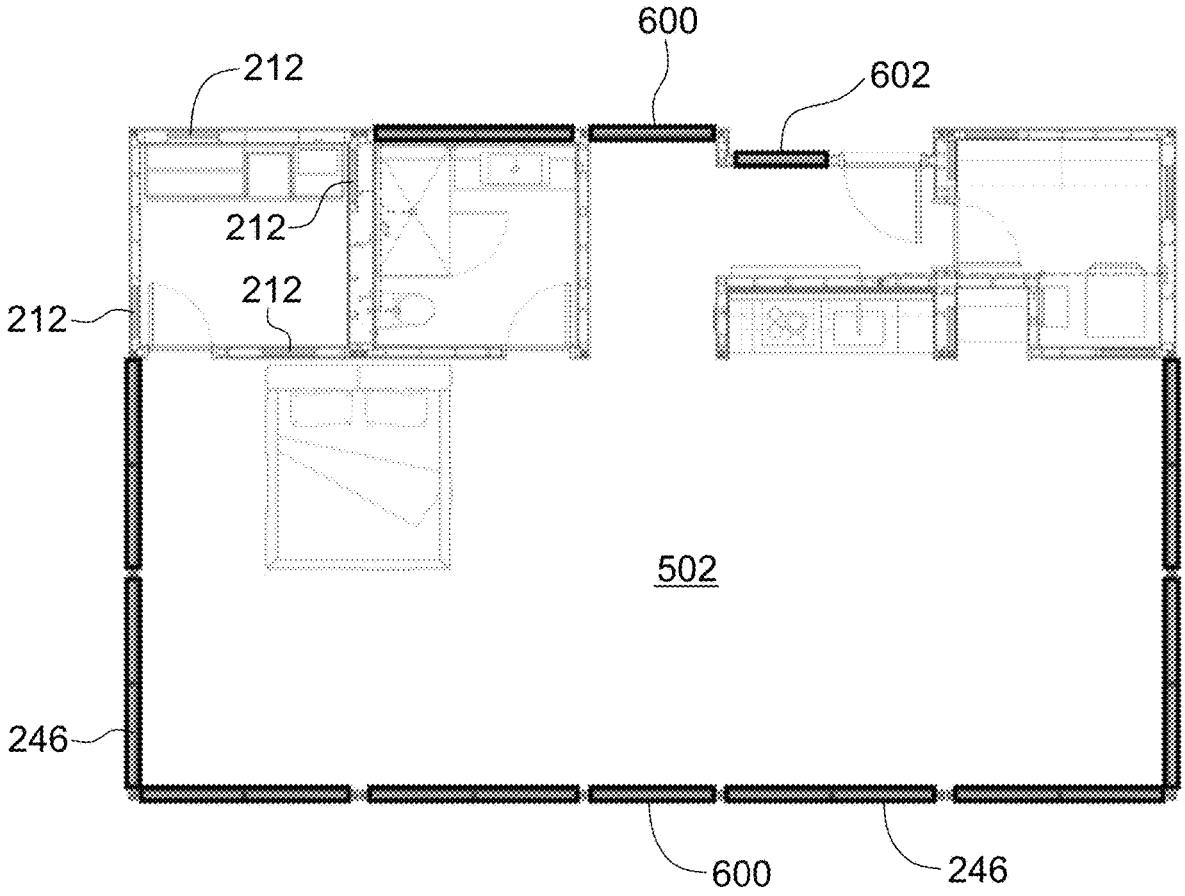
FIG. 6 illustrates the increased scope of window/door placement and quantity as a result of an embodiment of a UAS build approach.

FIG. 6 illustrates the increased scope of window/door placement and quantity as a result of an embodiment of a UAS build approach. In FIG. 6, multiple identical glazing systems 246 (e.g., window sections) provide the vast majority of the sides and front of the perimeter of structure 500, illustrating that in this embodiment, each unit 100 includes a floor section 232 that is twice as long as it is wide. Embodiments may include a floor section 232 that is up to 2.5 times as long. An additional glazing system 600 is adapted to the width of interstitial unit 406. A further glazing system 602 is provided next to the entry door.

FIG. 6 illustrates the benefits of the UAS over conventional construction. The constructed UAS unit further provides a structure that is designed to not limit the number, area and/or contiguous use of windows and doors. Conventional Site-built construction and Pre-fabricated installation can limit the linear footage of windows and doors that can be tolerated by the build envelope and restricts the possible locations of the same. However, the UAS unit allows up to 62% more windows and/or doors than conventional or prefabricated constructions. The increase in options for a variety of windows and door configurations in the constructed UAS unit provides the greatest possible flexibility in reconciling window placement relative to interior programs of use and exterior adjacencies and/or views.

Figure 18:
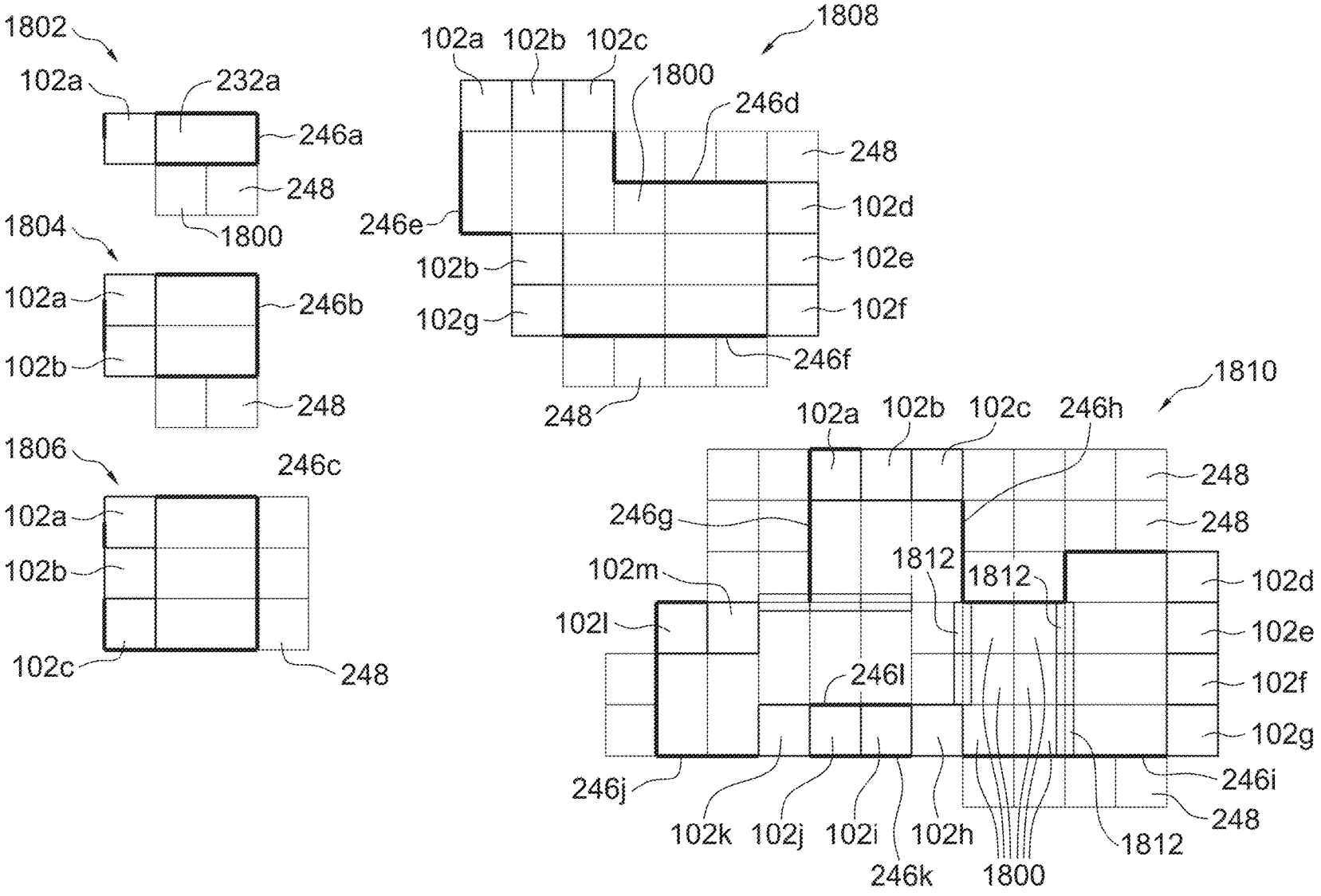
FIG. 18 illustrates schematic diagrams showing an example of the variety of ways embodiments of the UAS units can be connected together to realize different building scales and exterior envelopes.

The flexibility in the placement of windows and doors of the UAS unit allows multiple UAS units to be joined to form a larger building structure. The multiple UAS units can be joined in various orientations based on a customer's preferences. For example, FIG. 18 illustrates a variety of possible build envelopes (with the bold lines on the grid representing the location of glazing systems). In FIG. 18: glazing systems 246*k*, 246*l* include 2 glazing systems 246; glazing system 246*e* includes 3 glazing systems 246; glazing systems 246*d*, 246*f*, 246*g* include 4 glazing systems 246; glazing system 246*a* includes 5 glazing systems 246; glazing systems 246*b*, 246*j* include 6 glazing systems 246; glazing systems 246*h* include 7 glazing systems 246; and glazing system 246*c* includes 9 glazing systems 246.

In contrast to FIG. 6, a conventional frame or paneled construction places limitations on window/door placement and quantity. The limitations resulting from the required vertical structure footprint in a conventional framed or paneled construction execution. Structural needs of conventional and/or flat, pack systems limits the linear footage of windows and doors that can be tolerated by the build envelope and restricts possible locations of the same.

Figure 7:
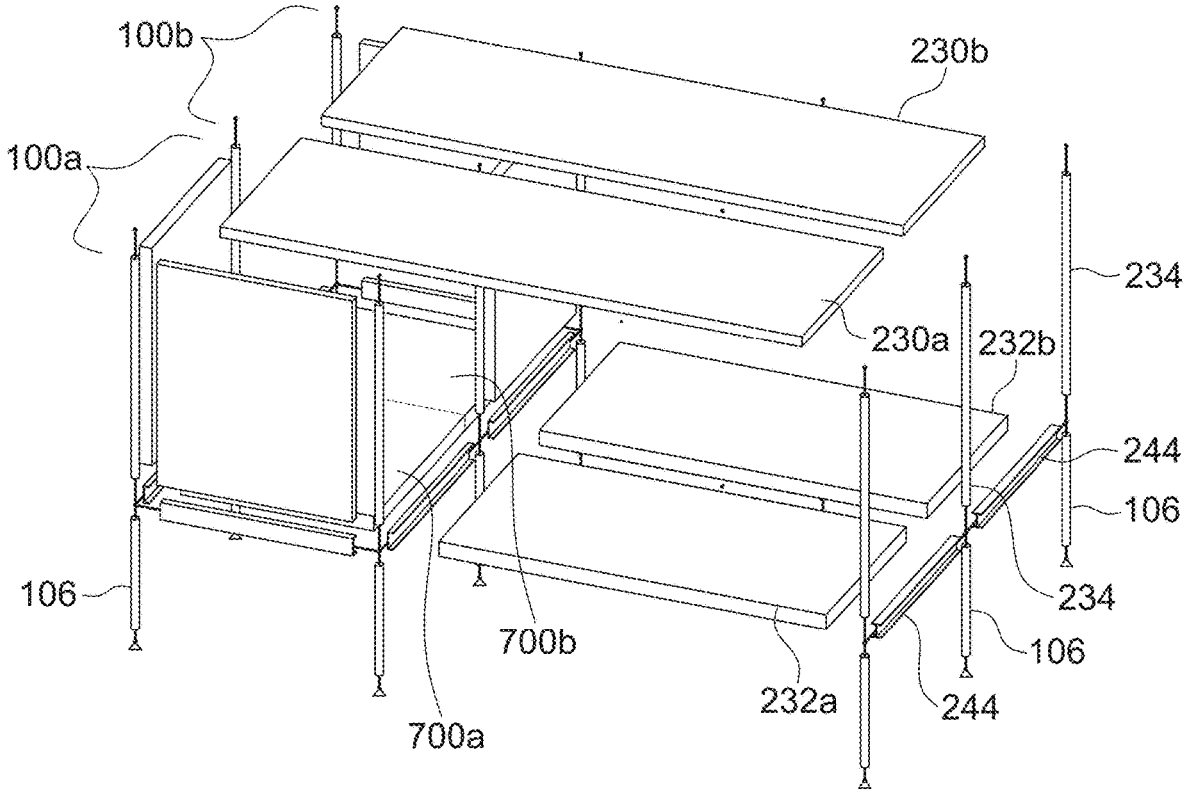
FIG. 7 illustrates the reduction of parts and overall weight made possible by an embodiment of the UAS building approach.

FIG. 7 illustrates the reduction of parts and overall weight made possible by an embodiment of the UAS building approach. In FIG. 7, the modules of units 100*a*, 100*b* are shown to include optional floor panels 700*a*, 700*b*, which represent a floor in a type of interior assembly 204 allowing for an open flow between adjacent modules 102. FIG. 7 illustrates the benefits of the UAS 100 over conventional construction. The UAS building approach provides for a reduction of parts and overall weight. This embodiment of the UAS building approach shifts the use of wood to spanning structural elements (ceiling 230*a*, 230*b*, floors 232*a*, 232*b*) only. The overall square footage of wood used is reduced by approximately 20%. Further, the number of parts required by the system is reduced by approximately 30-40%, lessening the overall building weight without compromising the structural integrity and/or performance of the UAS units/units.

In contrast to FIG. 7, a conventional site-build's requirement for vast quantities of parts, each of which needs to be shipped, handled, installed and maintained. For example, a conventional build (1,000 sf) can include up to 10,000 board feet of framing, and 7,000 sf of other wood materials such as sheathing. Further, a conventional build can have up to 500,000 parts needing to be produced, shipped, handled, installed, and maintained.

FIGS. 8A and 8B illustrate the UAS advantage of right-sizing of structural elements relative to the scale of structure of the planned build. FIG. 8A illustrates the truck bed delivery volume relative space capture advantage of the UAS and the UAS's ability to be executed on sites with difficult topography. In FIG. 8A, a transport 200 is shown laden with a module pack 802 including modules 102*a* . . . 102*d*. Transport 200 is also carrying a collective flat pack 800, which includes the flat packs 104 associated with each module 102*a* . . . 102*d*.

FIG. 8B illustrates the benefits of the UAS over conventional construction. Using the UAS, the truck bed delivery volume relative space capture advantage of the UAS. For example, the UAS hybridization of volumetric and flat pack methodologies in site execution increases effective space capture up to 4× greater per delivered truck bed load over conventional volumetric systems, which may only allow one conventional system per transport 200. Further, the system use of smaller elements opens up site placement possibilities and reduces need to remove tree obstacles for crane operations.

In contrast to FIG. 8A, there is inherent inefficiency in the site delivery of a conventional volumetric pre-fabricated build. In particular, conventional volumetric pre-fabricated systems require numerous and inefficient site deliveries yielding, on average, one bay of space capture per truck bed delivery. Further, the larger sizes of volumetric pre-fabricated units, very often based on common shipping container frame sizes, may limit the ability to install such systems on certain sites due to tree obstacles or site limitations on viable crane placement.

Figure 9:
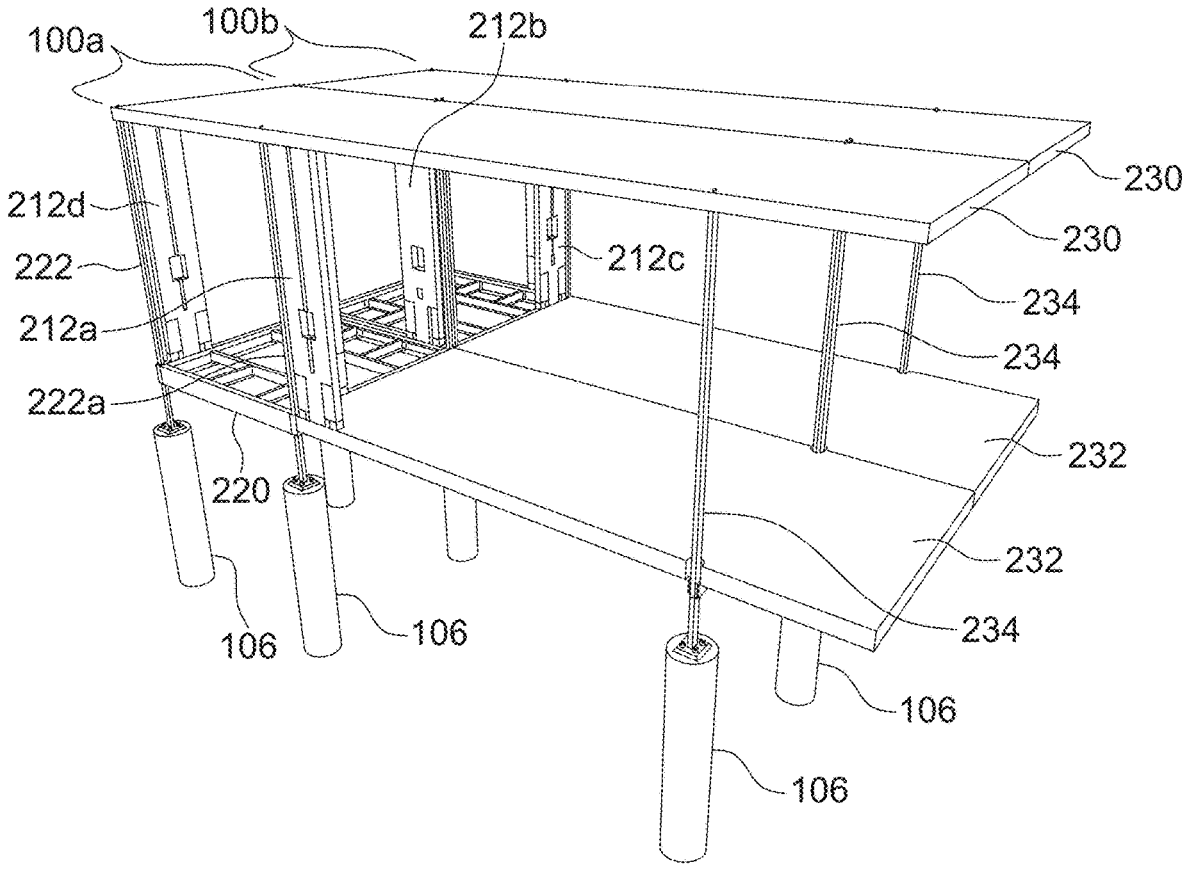
FIG. 9 illustrates the IAS advantage of right-sizing of structural elements relative to the scale of structure of the planned build.

FIG. 9 illustrates the UAS advantage of right-sizing of structural elements relative to the scale of structure of the planned build, which includes benefits of the UAS over conventional construction. In FIG. 9, UAS units 100 provide an advantage of right-sizing of structural elements relative to the scale of structure of the planned build. The UAS product development editing lens has focused on simplicity, cost efficiency, speed of execution for small to medium builds with structural members appropriately sized to meet robust building standards while avoiding inefficient extremes. FIG. 9 illustrates an optional configuration of floor 232, in which floor 232 extends past moment frame 242 to create a balcony section (see also FIG. 10).

As shown in FIG. 9, it may be possible to install a shear panel 212*a* outside of the base frame 220. However, embodiments provide shear panels within base frame 220, such as shear panels 212*b*, 212*c*, and 212*d*, which are sized and configured to provide sufficient shear strength for the entire structure of FIG. 9 without adding, or the need to add, an additional, external shear panel such as shear panel 212*a*.

In contrast to FIG. 9, a conventional bolt together steel assembly with member sizing that solves for averages rather than the specifics of a small-to-medium format planned build often results in expensive overbuilt construction. In other words, conventional approaches result in inefficiently oversized structures as a cost of gaining assembly efficiency. UAS avoids this through kit design tight-sized to the scale of builds as discussed earlier.

Figure 10:
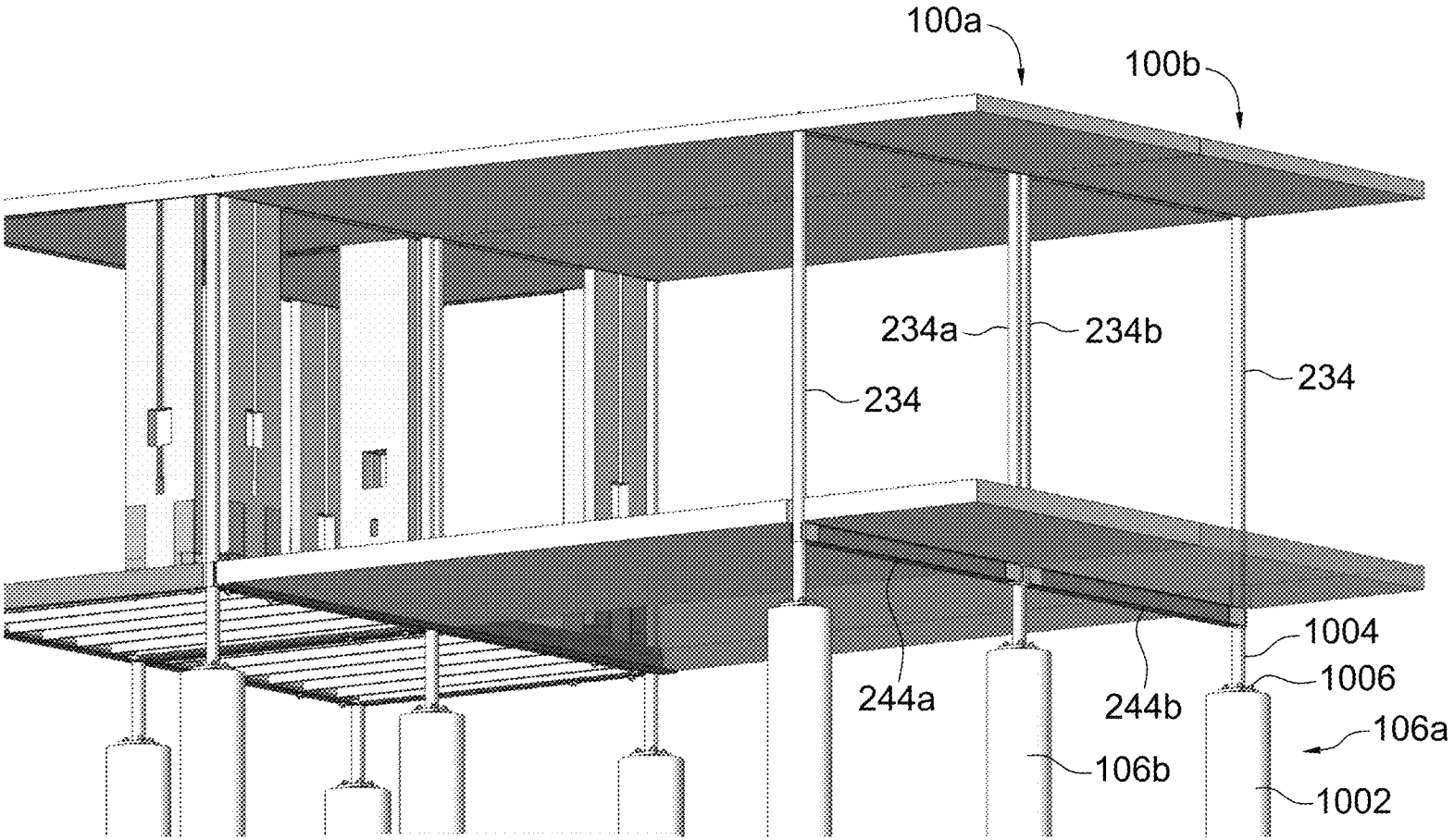
FIG. 10 illustrates an embodiment of a UAS from below the plane of the floor.

FIG. 10 illustrates an embodiment of a UAS from below the plane of the floor. In FIG. 10, column 106*a* illustrates an optional implementation of a foundational column 106 using a concrete pad 1002, with a pad connection 1006 attaching a telescoping section 1004 to cross bar 244*b*. FIG. 10 illustrates that all columns 234 and 222 may be cylindrical as well as the square cross-sectional columns depicted earlier. FIG. 10 illustrates the optional doubling of columns 234*a*, 234*b*, in comparison to the single column 234 of FIG. 7, and illustrates that cross bars 244*a*, 244*b*, may be adapted to connect such that only a single column is required to the concrete section.

Figure 11:
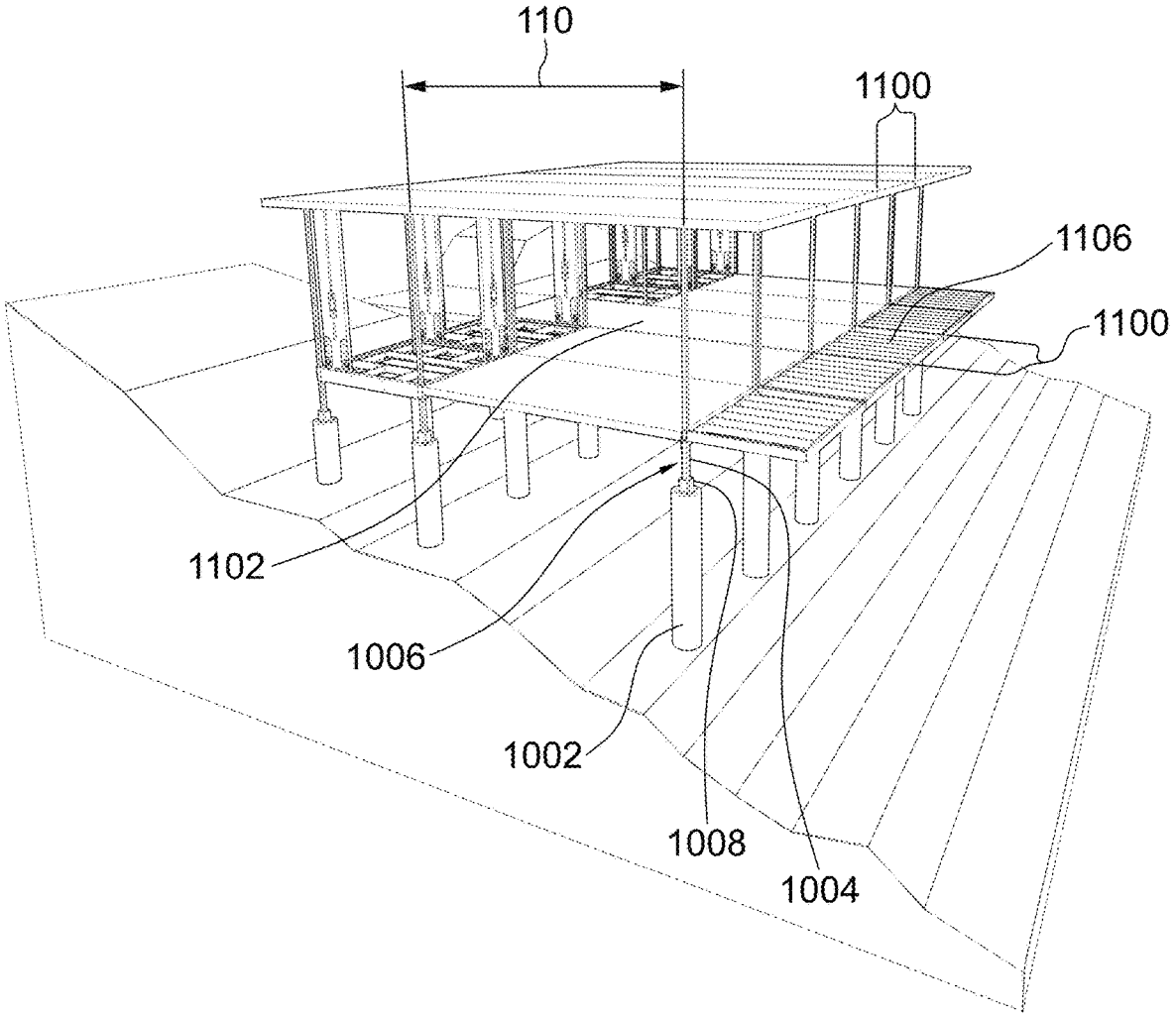
FIG. 11 illustrates an embodiment of multiple UAS structures assembled together and atop foundational columns.

FIG. 11 illustrates an embodiment of multiple UAS structures assembled together and atop foundational columns. In FIG. 11, column telescoping section 1004 is shown to telescope with respect to lower telescoping unit 1008 atop pad connection 1006 (not shown). An interstitial unit 1100, which does not include a structural module 102, is shown to provide an interstitial floor 1102 and an interstitial balcony 1106. FIG. 11 illustrates that interstitial units may have the same width and length as units with modules 102, and that the structural elements, including shear panels 212, of the associated modules 102 are sufficient for the entire assembled structure. Elements of interstitial units may also have extended dimensions, e.g., a floor to include a balcony as floors 232 do in FIG. 9, or a floor to include an entryway as shown in FIG. 11, floor 1102.

Figure 12:
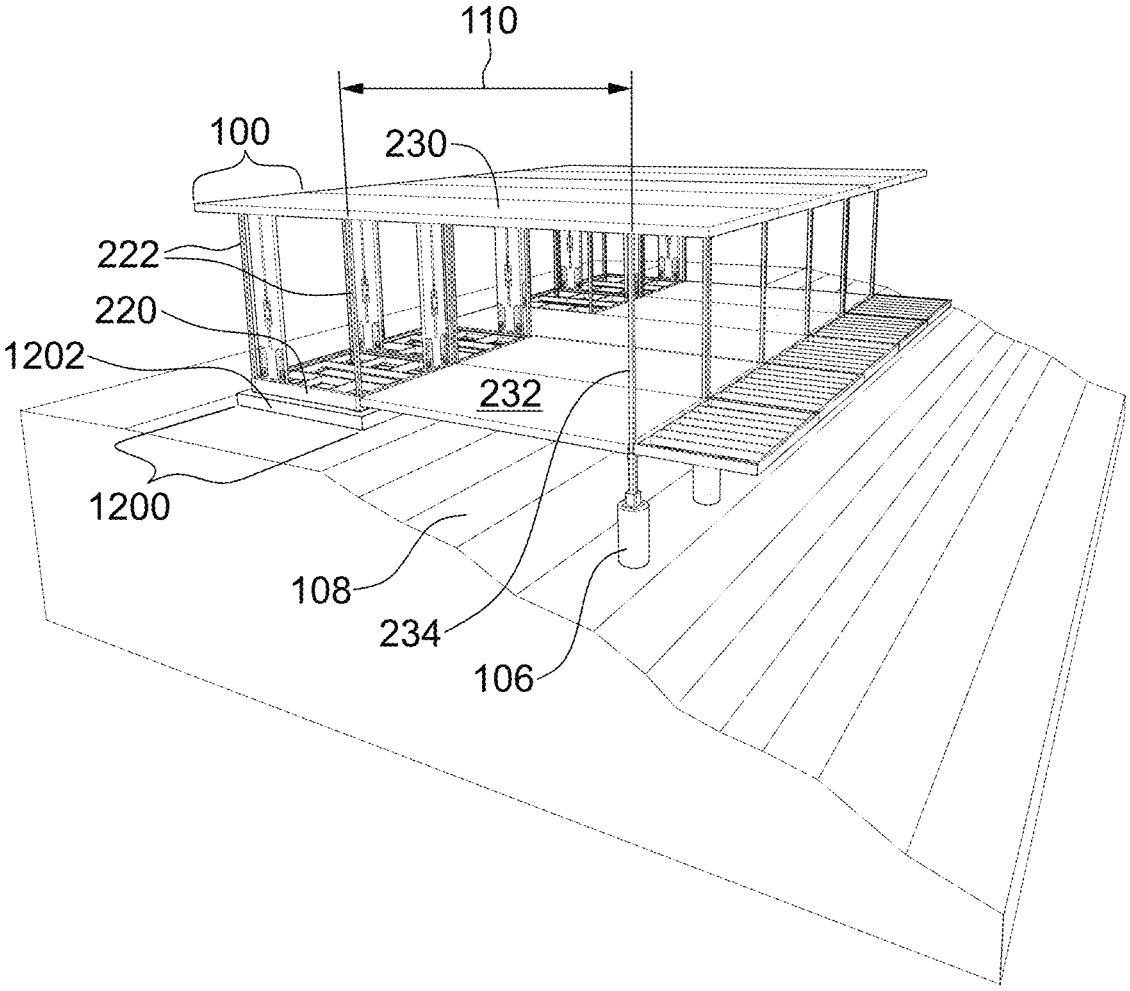
FIG. 12 illustrates the embodiment of multiple UAS structure assembled together and atop both foundational columns and a reduced footprint slab foundation.

FIG. 12 illustrates the embodiment of multiple UAS structure assembled together and atop both foundational columns and a slab foundation. In FIG. 12, a slab foundation 1200 may optionally be provided for modules 102 of the structure. Prepped site 1202 shown to illustrate that, even with the use of a partial slab foundation 1202, the amount of site 108 requiring modification is limited. In embodiments, a slab foundation may be provided below different sections of unit 100, or below the entire unit 100. Also, unit 100 may be adapted to other surfaces. For example, for the rooftop location of FIG. 3 a UAS unit would be designed to align its point load transfer to the building beneath specific to the logic of the structure it is installed upon.

FIGS. 13-17 illustrate an exemplary embodiment of sequential steps in the construction of a UAS unit 100. While one or more implementations have been described by way of examples and in terms of the specific embodiments, it is to be understood that one or more implementations are not limited to the disclosed embodiments. To the contrary, it is intended to cover various modifications and similar arrangements as would be apparent to those skilled in the art. Therefore, the scope of the appended claims should be accorded the broadest interpretation so as to encompass all such modifications, similar arrangements of sequential steps in constructing of a unit or building.

Figure 13:
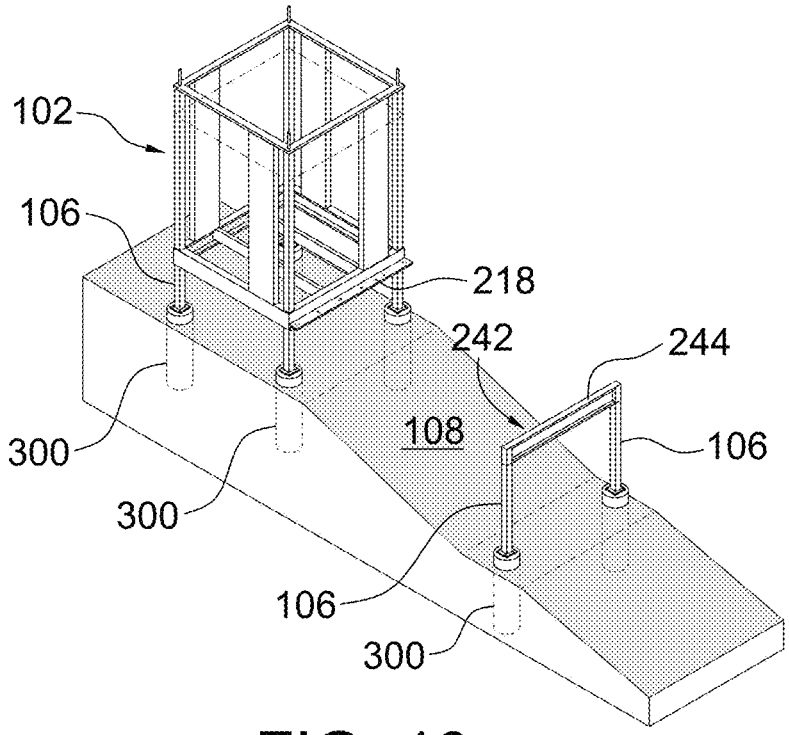
FIG. 13 illustrates first and second steps in an embodiment of a construction sequence of the UAS project involving the installation of the program unit (a dimensional structural unit) and the installation of a moment frame with lateral moment connection in plane with floor.

FIG. 13 illustrates first and second steps in an embodiment of a constriction sequence of the UAS project involving the installation of the program unit (a dimension structural unit) and the installation of a moment frame.

FIG. 13 illustrates an example of the topography of a build site 108. In this example, the topography a hilly terrain with a downward slope. Such terrain is considered difficult to build upon using conventional methods, whether Site-built construction or Pre-fabricated. The biggest hurdles boil down to two main factors: the gradient of the slope of the build site and whether the build site is up-slope or down-slope. Beyond a 15% incline or decline on the build site, costs begin to increase significantly as the risks of construction issues become greater and the construction work becomes more difficult due to materials staging, handling and requirements for site grading for foundation implementation.

For example, She cost of installing a complex foundation system required for buildings being built on hilly terrain is often more than the cost of a comparably sealed occupiable structure alternately built on a flat site. The foundation of a building on an even a moderately sloped build site requires more disruptive site re-grading, increased material demands, deeper excavation by specialized excavation equipment or blasting, and extra retaining walls or terraces Additionally, if the terrain requires cutting, the resulting extra soil will either have to be exported from site or incorporated into the on-site re-grading as a fill condition. Even if cutting/excavation is not required, a flat staging area for vehicles, equipment, and deliveries will be required which is typically more generous an area than a typical access drive and can be costly and ecologically disruptive. These hurdles not only exist with Site-built construction methods, but also exist with Prefabricated installation.

The first step in the construction sequence of the UAS unit on a building site begins after the site 108 has been prepared, with the excavation of holes 300, and the foundation, including columns 106 has been installed and cured, anticipating the arrival of the UAS. Initially, the volumetric structural element (module 102), the UAS bolt-together moment frame system 242, and the flat-packed structural elements 104, such as the cross-laminated timber (CLT) flooring 232 and roofing 230, are delivered to the build site. Both the steel structural core 102 and the CLT flooring and roofing can be easily transported to build sites even when roads to the build site may be difficult to navigate because of their compact sizes. The UAS elements are deliberately designed to be small and easier to manipulate that large scale Volumetric pre-fabricated modules allowing a delivery load to be broken down at the nearest improved road for choreographed import to the erection site.

The UAS system has been designed to be compatible with a variety of foundation types (slab, grade-beam, pier, helical pier, etc.) appropriate to a broad range of topographical and soils conditions through bespoke designed connections that consider the holistic structural performance of the system. In other words, columns 106 may include any such column type in embodiments, and a slab may be used instead of columns 106.

FIG. 13 also illustrates the second step in the construction sequence of the UAS unit. Once the structural core 102 has been secured to the foundation, the bolt-together moment frame 242 is installed. The moment frame comprises a set of two structural steel columns connected to a lateral member that delivers shear control. The first moment frame installed is the "parent" moment frame. Subsequent moment frames register to this first one in a child-to-parent relationship following the same centerline with the ability to adjust for tolerance.

Figure 14:
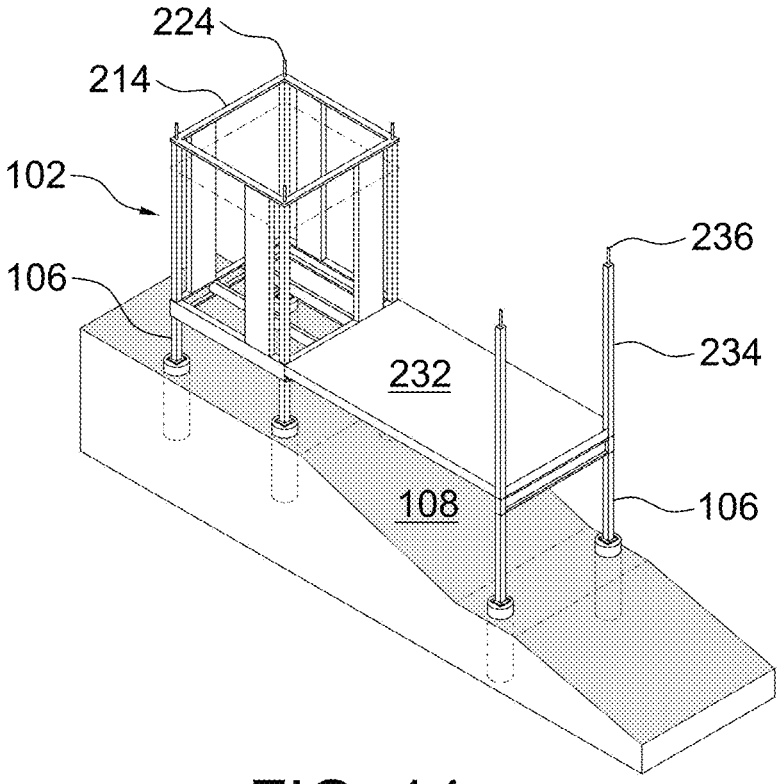
FIG. 14 illustrates the third and fourth steps in the embodiment of the construction sequence of the UAS project involving the installation of a spanning floor member made of cross-laminated Timber (CLT) and the installation of bolt-on gravity columns.

FIG. 14 illustrates the third and fourth steps in the embodiment of the construction sequence of the UAS project involving the installation of a spanning floor member made of cross-laminated Timber (CLT) and the installation of bolt-on gravity columns. The third step in the construction sequence of UAS unit 102 follows the installation of moment frame 242. Once the moment frame has been installed, flooring 232 is installed to span between ledger 218 (steel angles, appropriately sized) of volumetric structure core module 102, and the ledger (or cross bar 244), of moment frame 242. Flooring 232 may be bolted, or timber-riveted into position (per seismic requirements) to base frame 220 and to cross bar 244.

The height of the moment frame ledger (cross bar 244) can be fine adjusted to ensure that the crane-placed CLT flooring is level in the resulting occupiable space capture. The approach to localized adjustment in the UAS system accommodates tolerance in execution on difficult build sites.

In an embodiment where an interstitial spanning element is to be installed between units 100, one or more corbels will be added to the assembly so the interstitial elements have a bolt-to connection to adjacent units 100, e.g., to base frame 220, or to cross bar 244.

In a fourth step in the construction sequence of the UAS unit 100, gravity columns 234 are bolted on cross bar 244 atop columns 106 to extend the two vertical support column line of the moment frame. Gravity columns 234 will be used to support the roofing 230 that will extend from Its bolt-secured position on the volumetric structural core 102 (See FIG. 15). Roofing 230 may be secured to gravity columns 234 using known methods, such as bolts, fasteners, and the like. As an example, columns 234 are shown to include threaded fasteners 236. The support of gravity columns 234 prevents any roof deflection, such as bending or sagging that would impact glazing systems 246 installed below in a seismic event. Roofing 230 may extend beyond the gravity column line at the moment frame to provide a generous overhang for solar-gain control or protection for a subsequent bolt on deck element, e.g., balcony 248.

As discussed, in an embodiment, roofing 230 substantially performs as a cantilever spanning member. In other words, roof 230 extends horizontally and is supported mostly by structural core 102, which controls for offset height and rotational forces in concert with the foundation anchorage of columns 106, Therefore, roof 230 does not need to be supported by rafters, trusses, or intrusive support beams within the interior of the UAS unit. The UAS unit has a unique open space interior layout that allows architects to modify the interior in various unrestricted ways.

Figure 15:
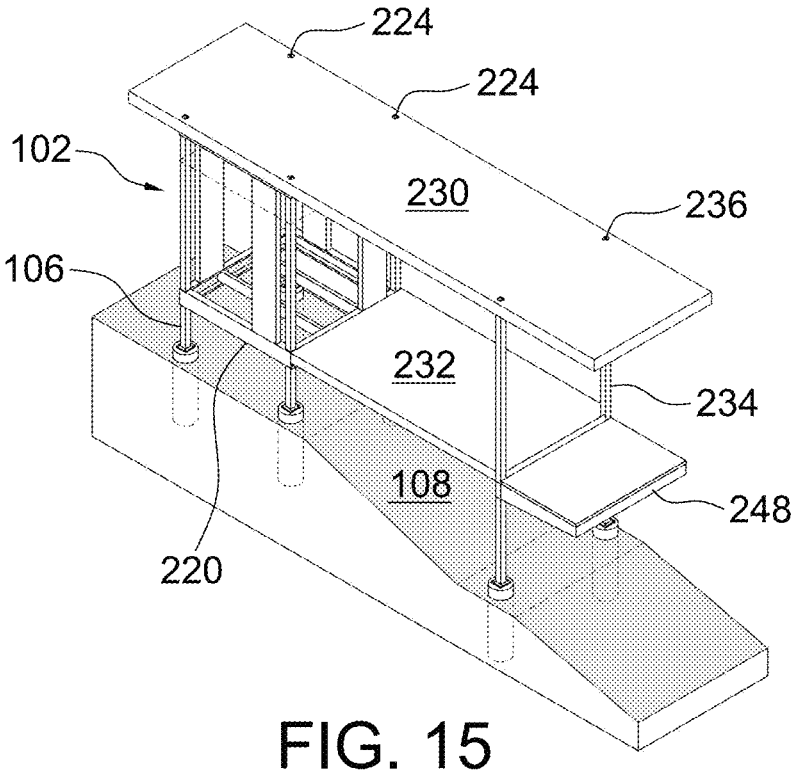
FIG. 15 illustrates the fifth and sixth steps in the embodiment of the construction sequence of the UAS project involving the installation of a CLT ceiling/roof substrate and the installation of a bolt-on pre-fabricated deck.

FIG. 15 illustrates the fifth and sixth steps in the embodiment of the construction sequence of the UAS project involving, in the fifth step, the installation of roof 230. The optional sixth step is the installation of a bolt-on pre-fabricated deck 248. In an embodiment, pre-fabricated exterior deck 248 is bolt-secured to horizontal cross bar 244 of moment frame 242.

Figure 16:
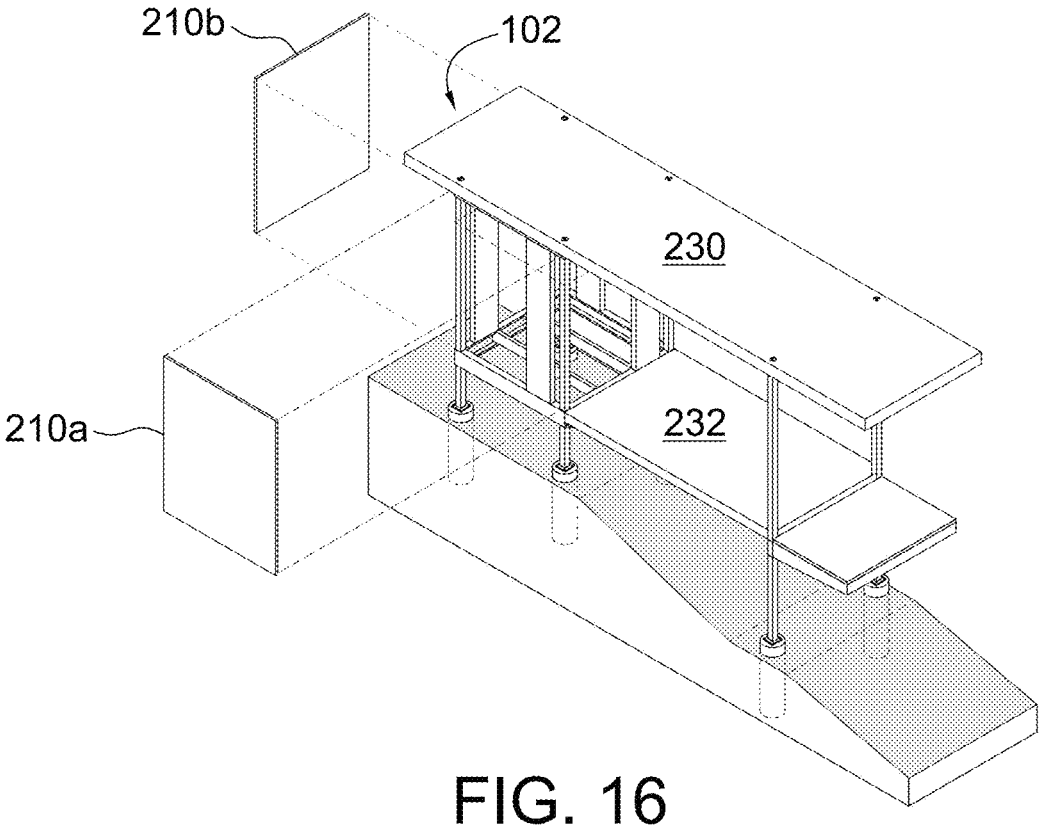
FIG. 16 illustrates a seventh steps in the embodiment of the construction sequence of the UAS project involving the installation of exterior cladding.

FIG. 16 illustrates a seventh step in the embodiment of the construction sequence of the UAS project, involving the installation of exterior cladding. In the seventh step, exterior cladding 210*a*, 210*b*, 210*c* (FIG. 17), previously discussed as demountable shipping panels 210, are added to the three sides of structural core, module 102, that constitute the outer walls of the UAS unit 100. In one embodiment, exterior cladding 210*a* . . . 210*c*, may be made up of several layers, including a wall's outer surface, a plastic wrap to keep out moisture, insulation, and vapor barriers, among others as is typical for a rainscreen cladding implementation.

Exterior cladding 210*a* . . . 210*c* is installed towards the end of the construction sequence of the UAS unit to make the building inspection process less cumbersome. Conventional construction requires multiple trade-specific inspections that gate-check the serial production of a build process. Because these inspections occur substantially on the interior of the space, a single inspection failure can result in significant completion delays due to sequence dependencies. In contrast, the UAS unit inverts the "inspection space" from interior to exterior so that volumetric elements, i.e., module 102, can be delivered to the build site with full trade integration and interiors complete Site inspections are made from the exterior of the unit. If the site inspection is not complete prior to installing exterior cladding 210*a* . . . 210*c*, exterior cladding 210*a* . . . 210*c* may be removed (demounted) to eliminate the gate-checking consequences of inspections and substantially reduce overall implementation time. Exterior cladding 102*a* . . . 102*c* also protect the assembly during transport, in embodiments, exterior cladding 210*a* . . . 210*c* may include smaller panels (not shown) that may be removed to provide access for inspecting areas between columns 222 of steel structure 202.

In an embodiment, exterior cladding 210*a* . . . 210*c* (i.e., shipping panels 210) may be removed and re-used as finished architectural enclosure panels, installed in the same position on module 102 by the same means as originally attached to module 102.

Figure 17:
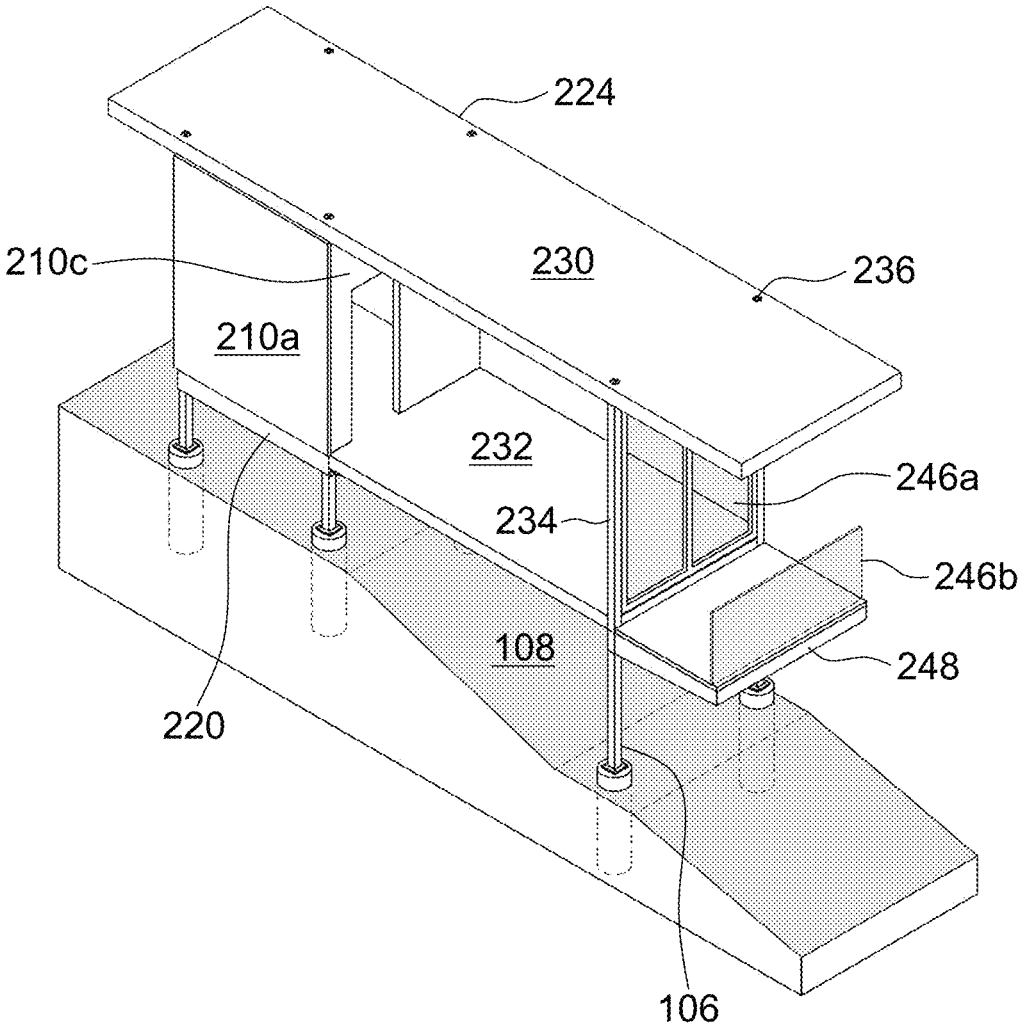
FIG. 17 illustrates an eighth step in the embodiment of the construction sequence of the UAS project involving the installation of exterior windows, doors, and railings.

FIG. 17 illustrates an eighth step in the embodiment of the construction sequence of the UAS project involving the installation of exterior windows (glazing system 246, including windows 246*a*), doors, and railings 246*b* (part of glazing system 246). In the eighth step in the construction sequence of the UAS unit, windows, doors, railings, and other final envelope flat pack elements may be installed either before, in tandem with, or following the completion of the exterior cladding of the volumetric structural element described above. For example, as illustrated in FIG. 17, glass railing 246*b* can be installed on exterior deck 248, along with a glass sliding door 246*a*, that, leads to exterior deck 248. Although not illustrated, glass windows or walls can be installed to close the portion of the unit between the structural core and the moment frame.

FIG. 18 illustrates schematic diagrams showing an example of the variety of ways embodiments of the UAS units can be connected together to realize different building scales and exterior envelopes. In FIG. 18, glazing systems 246*a* . . . 246*k* are illustrated as thicker lines. FIG. 18 illustrates that modules 102*a* . . . 102*m* may be assembled in various configurations, each model with an associated floor 232*a*(other floors 232 not numbered). Sections 1800 indicate balcony sections when outside of a floor/module combination, or interstitial sections when between a combination of floors and modules. Many configurations of units 100 are possible. For example, a single configuration 1802, a double parallel configuration 1804, a triple parallel configuration 1806, a first complex configuration 1808 including eight units 100, and a second complex configuration 1810 including 13 units 100. Complex configuration 1810 illustrates the use of offsite assembled unit 1812. For example, office assembled unit 1812 may be a unit, assembled offsite, that acts as a room divider, a closet, or a mechanical services network point. Unit 1812 is an optional element that may be used in complex builds where unit arrangement is creates very large interior spaces that may demand partitioning in order to suit the particular use.

Thus, multiple UAS units can be joined in various orientations based on a customer's preferences. FIG. 18 illustrates a variety of possible configurations of a plurality of UAS units to create structures at a variety of scales, wherein all the scales honor small building format cost models.

Figure 19:
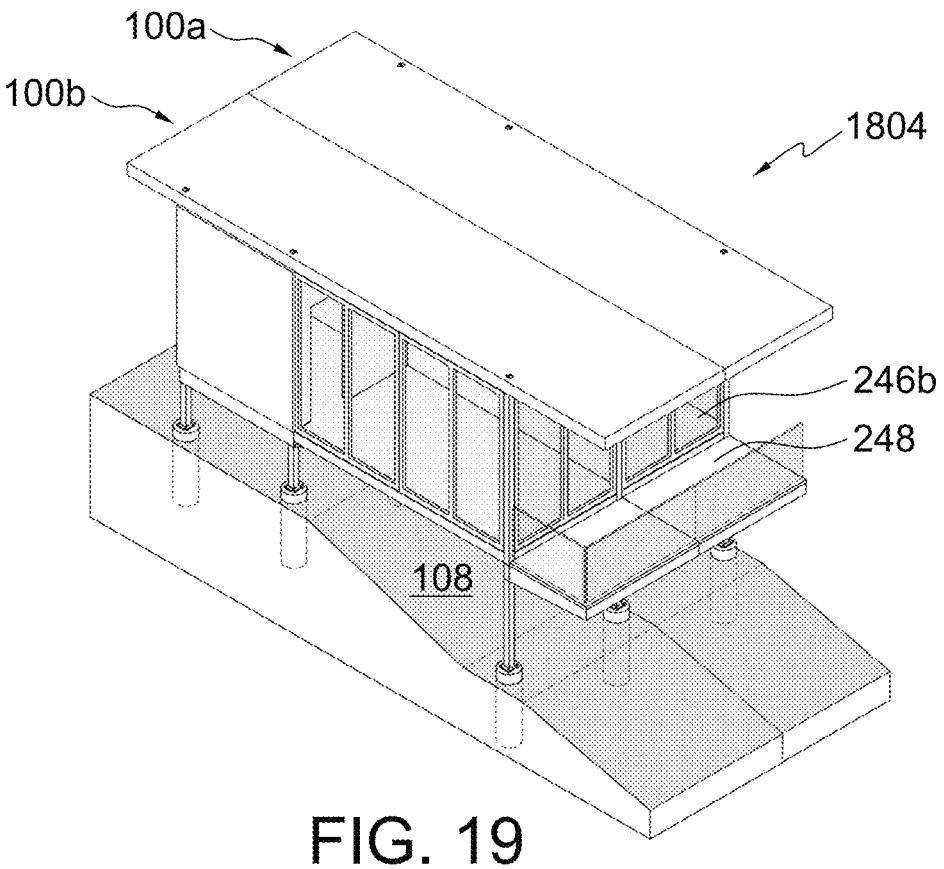
FIG. 19 illustrates an example of an embodiment of a UAS unit being connected to form larger building structures using a Side-by-Side method.
Figure 22A:
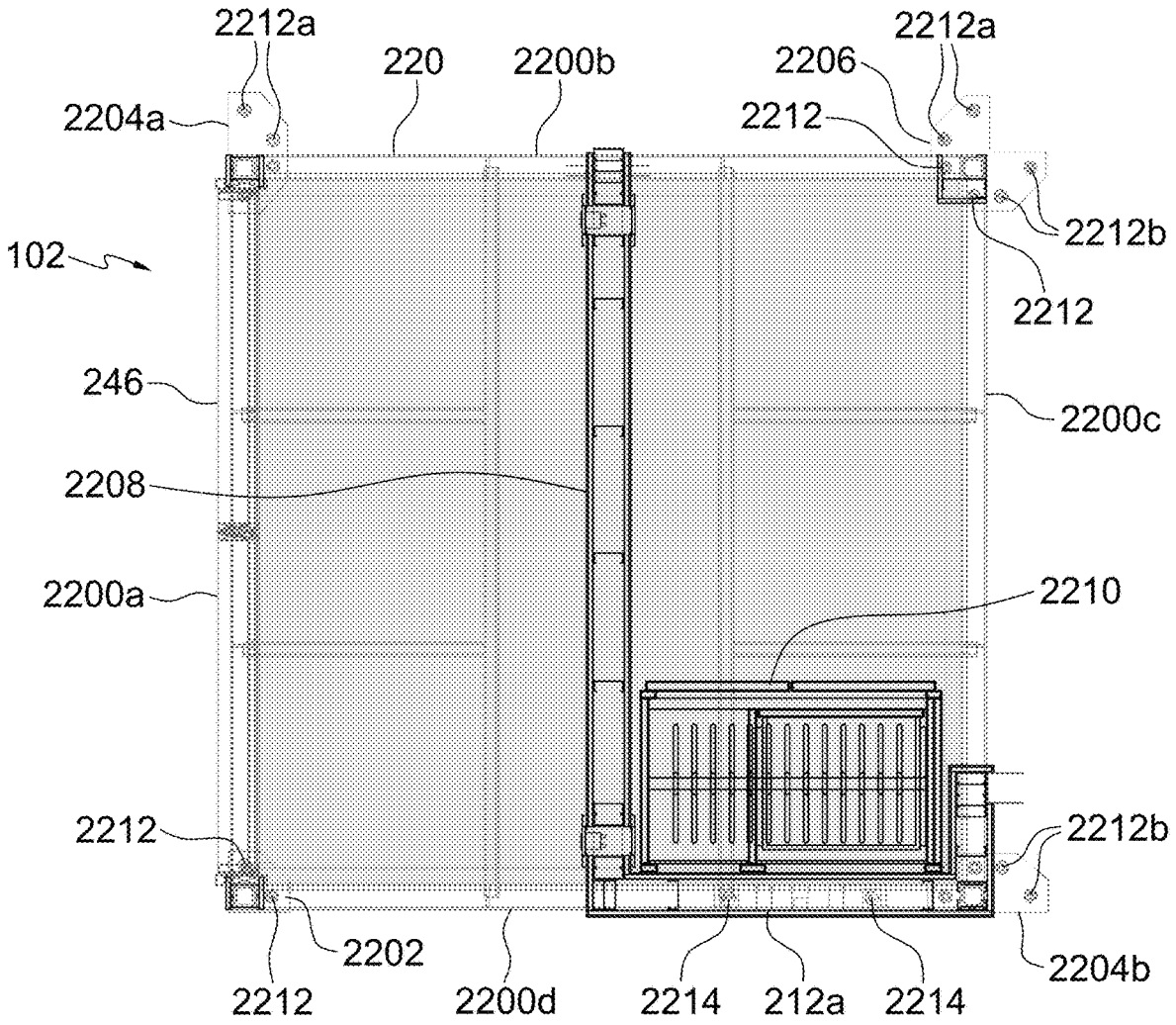
FIG. 22A illustrates an example of a layout of an embodiment of a UAS building block module.
Figure 22B:
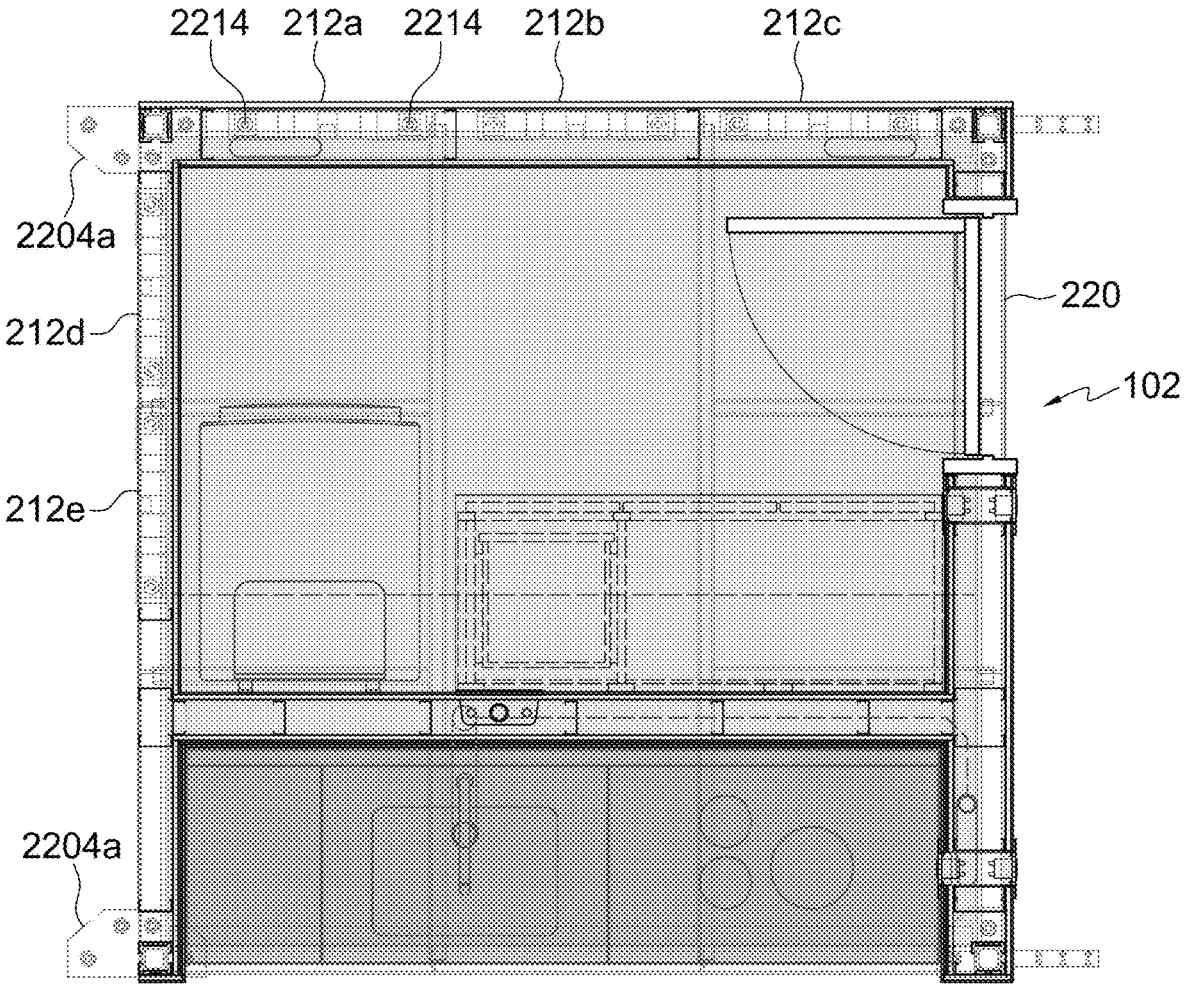
FIG. 22B illustrates an example of a layout of an embodiment of a UAS building block module.

FIG. 19 illustrates an example of an embodiment of a UAS unit being connected to form larger building structures using a Side-by-Side method. FIG. 19 illustrates one of the three ways that UAS composite units 100 have been designed to join together, which results in double parallel configuration 1804. Once one UAS unit has been installed on a building site, a second UAS unit can be installed in the same manner as described in previous paragraphs. In the "Side-by-Side" scenario of installation configuration, multiple UAS composite units can be structurally unified, through common foundation supports (e.g., column 106*b* of FIG. 10), the parent-child relationship of the bolt on moment frame system (as discussed with reference to FIG. 13), and additional stitching elements, such as steel plates that connect more than one roof 230 or floor 232 together through mechanical fastening with bolts, structural screws, or timber rivets (depending on seismic code at location of build)). FIGS. 22A and 22B describe such connections and related elements with regard to modules 102.

Figure 20:
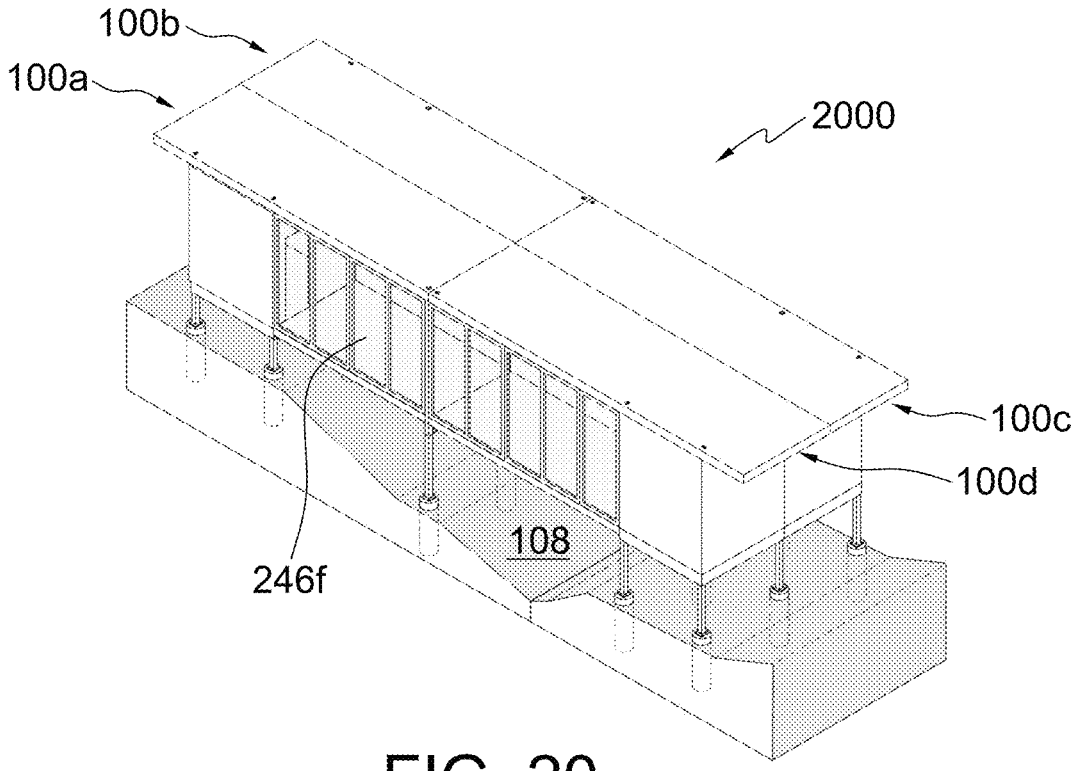
FIG. 20 illustrates an example of an embodiment of a UAS unit being connected to form larger building structures using an End-to-End method.

FIG. 20 illustrates an example of an embodiment of a UAS unit being connected to form larger building structures using an End-to-End method. FIG. 20 illustrates the second of the three ways that UAS composite units have been designed to join together to form a larger structure—complex configuration 2000. In the "End-to-End" scenario of complex configuration 2000, multiple UAS composite units 100 are structurally unified, through common foundation supports (such as column 106*b* of FIG. 10), the parent-child relationship of the bolt on moment frame system, and additional stitching elements (steel plates that connect to more than one CLT element together through mechanical fastening with bolts, structural screws, or timber rivets (depending on seismic code at location of build)) as described with reference to FIG. 19.

Figure 21:
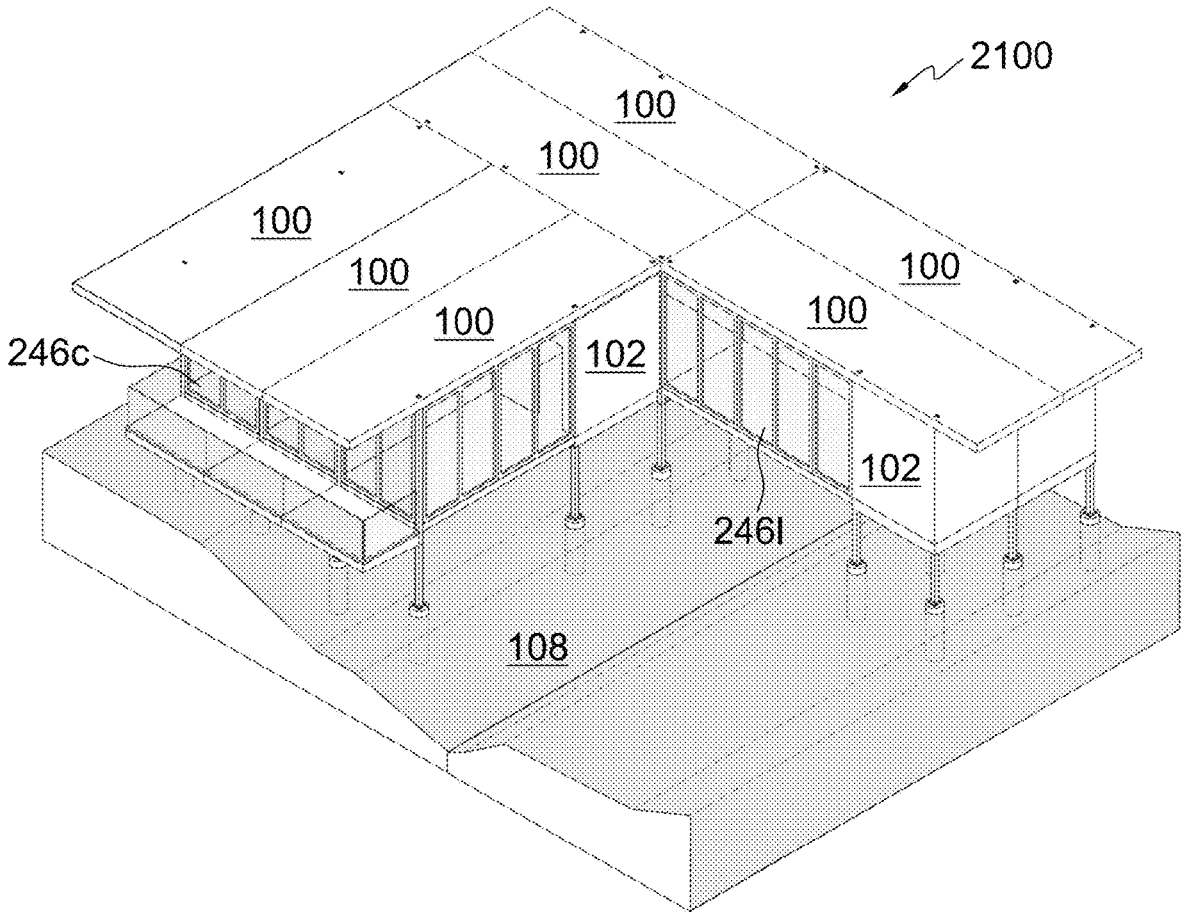
FIG. 21 illustrates an example of an embodiment of a UAS unit being connected to form larger building structures using a Rotated method.

FIG. 21 illustrates an example of an embodiment of a UAS unit being connected to form larger building structures using a Rotated method. FIG. 21 illustrates the third of the three ways that UAS composite units have been designed to join together to form a larger structure. In the "rotated" scenario of complex installation configuration 2100, multiple UAS composite units 100 are structurally unified, through common foundation supports, the parent-child relationship of the bolt on moment frame system, and additional stitching elements (steel plates that connect to more than one CLT element together through mechanical fastening with bolts, structural screws, or timber rivets (depending on seismic code at location of build)) as described with reference to FIG. 19.

Thus, in a single UAS site execution a structure may use any combination of the above methods to combine UAS composite units to create a larger structure with a great deal of flexibility to specialize architectural program, shape building envelope and create a built outcome that responds to the various constraints and opportunities of any building site.

FIG. 22A and FIG. 22B illustrate example layouts of embodiments of a UAS building block module 102 from below. In FIG. 22A, sides 2200*a* . . . 2200*d* of module 102 are configured differently. Side 2200*a* is composed of a glazing system 246. Sides 2200*b*, 2200*c* have exterior panels, but no shear panel Side 2200*d* includes a shear panel 212*a* connected to base frame 220 using shear panel bolts 2214. FIG. 22A illustrates a corner brace plate 2202 between sides 2200*a* and 2200*d* connected to base frame 220 using plate bolts 2212. A two-module connecting plate 2204*a* is shown attached to side 2200*b*. Connecting plate 2204*a* and a three-module connecting plate 2206 would be used to connect a module (not shown) to side 2200*b*. Unit 102 of FIG. 22A is shown to include an interior wall 2208 and a closet 2210, which indicate some of the unlimited waves that module 102 may be configured Plate connector 2206 and plate connector 2204 include bolts 212*b* which may be used to connect a module 102 (not shown) to side 2200*c*.

FIG. 22A, with a single shear panel 212*a*, illustrates that a module 102 may be configured with one or more shear panels 212 such that the module, when combined with other modules, provides sufficient shear strength for the combined structure, even though the particular module, if by itself, would not possess sufficient shear strength. For example, in this instance, module 102 does not include a shear panel along either of walls 2200*a* or 2200*c*, which results in module 102 of FIG. 22A not possessing sufficient shear strength along a plane defined by interior wall 2208.

FIG. 22B also illustrates an example of a layout of an embodiment of a HAS building block module. In FIG. 22B, the top wall includes shear panels 212*a* . . . 212*c* and the left side wall includes shear panels 212*d*, 212*e*. This illustrates that a module 102 may be configured with more shear panels 212 than it needs, by itself to have sufficient shear strength. Thus, such a module may be combined with other modules with insufficient shear strength, to provide sufficient shear strength for the combined structure. Unit 102 of FIG. 22B also illustrates an interior configuration that is different from that shown in FIG. 22A, and that includes kitchen elements and an entry door.

FIGS. 18-22 illustrates that a wall of module 102 will, when multiple units 100 are assembled together, be an exterior wall or all or part of an interior wall. If part of an interior wall, one side of the wall will be covered by a wall of the adjacent unit. To address such situations where one wall abuts an adjacent wall, in the planning stages of a unit build, the walls can be sequenced as walls with wall cavities to be inspected as either exterior walls, or as interior walls that can have removable interior panels that can be demounted for inspection and remounted once approved. An example of the latter is kitchen module shown in 22B. The laundry millwork and equipment in the upper portion of the unit may be put into position after the cavity showing the kitchen sink plumbing has been inspected. In an embodiment, exterior walls of a unit 102 will be clad with shipping panels 210. In some structural assemblies, a module 102 will have only two possibilities for exterior walls: one wall (when it is inline, sandwiched between others), or 2 walls, when it is in a corner condition.

Figure 23:
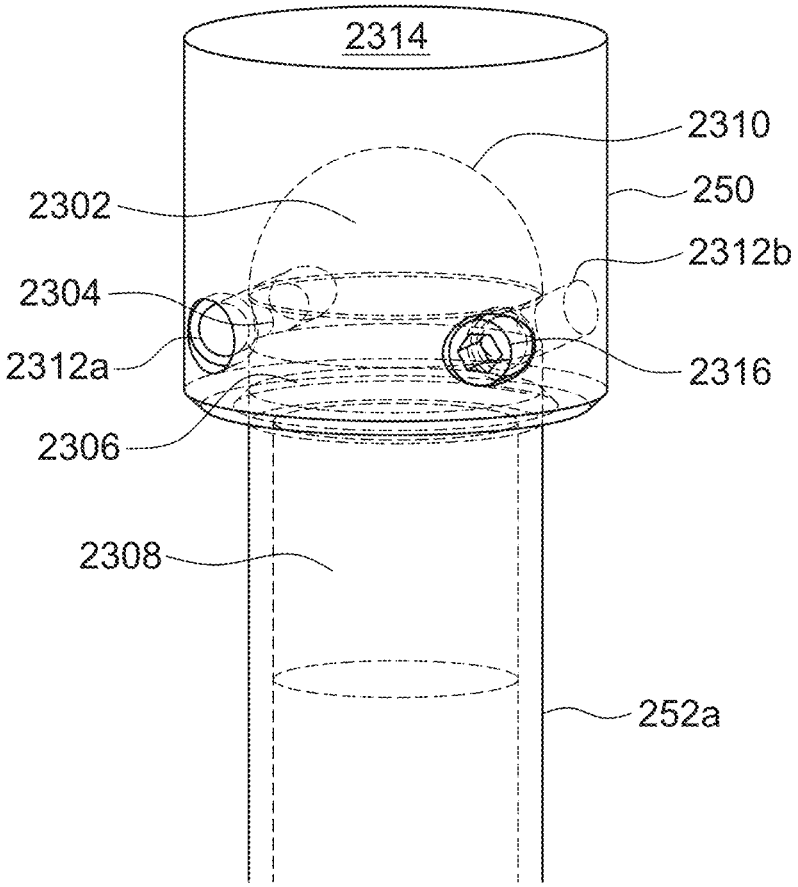
FIG. 23 illustrates an aspect of an embodiment of a UAS unit.

FIG. 23 illustrates an aspect of an embodiment of a UAS unit. As discussed with reference to FIG. 2A, columns 106 may be attached to base frame 220 and to cross bar 244 using a column connector 250. As illustrated in FIG. 23, column connector 250 includes a hemispherical recess or socket 2310 and holes 2312*a*: 2312*b* for retaining bolts, e.g., bolt 2316. Connector 250 may be connected to base frame 220 at upper connector face 2314. Connector 250 may be connected to cross bar 244 along a side of connector 250. Similarly, connector 250 may be incorporated into the corners of base frame 220 such that it does not extend below frame 220 and is at the same level as connectors 250 attached to cross bars 244. Below hemisphere 2302, a circumferential groove 2304 is formed into a lower section 2306, which is connected to an end plug 2308. End plug 2308 may be press fit or otherwise secured into the upper end of a cylindrical column 106, e.g., column 252*a* (FIG. 2A).

After columns 106 have been positioned and ready for module 102 and cross bar 244 to be installed, connectors 250 on module 102 and cross bar 244 are lowered onto hemispheres 2302. To secure connectors 250 to hemispheres 2302, bolts 2316 are installed into holes 2304. After being installed, bolts 2316 engage circumferential groove 2304, which prevents hemisphere 2302 from being extracted. Thus, module 102 and cross bar 244 may be fixed to columns 106. A benefit of the hemispherical recess 2310 and hemisphere 2302 is that column 252*a* may be rotated about its axis without affecting the ability of module 102 or cross bar 244 to connect perfectly. In contrast, square columns may require that their sides are parallel to elements of module 102 or cross bar 244, which complicates the installation of columns 106.

In an embodiment; a structure comprises a plurality of assemblies, each assembly including: a rectangular base frame; a rectangular upper frame corresponding to the rectangular base frame; a first set of columns, one provided at each corner of the rectangular base frame, each column of the first set attached to the rectangular base frame at a base end, and an interior assembly provided within a space defined by the rectangular base frame, the rectangular upper frame, and the first set of columns; a set of shear panels connected to the structure with a first subset of the shear panels connected to the structure in parallel with a first side of a first rectangular base frame and a second subset of the shear panels connected to the structure in parallel with a second side of the first assembly, each rectangular floor connected to the rectangular base frame and the cross member, and a plurality of rectangular ceilings, one for each assembly, each rectangular ceiling connected to an assembly and connected to a floor frame, wherein: the set of shear panels and the plurality of assemblies, without the Interior assemblies, provide shear support sufficient for the structure.

The following paragraphs include enumerated embodiments.

Embodiment 1 is a structure comprising:

a first assembly including:

a first rectangular base frame;

a first rectangular upper frame corresponding to the first rectangular base frame;

a first set of columns, each corner of the first rectangular base frame provided with a different column from the first set of columns, each column of the first set attached to the first rectangular base frame at a base end; and a first interior assembly provided within a first space defined by the first rectangular base frame, the first rectangular upper frame, and the first set of columns;

a set of shear panels connected to the structure such that at least one shear panel is connected in parallel with a first side of the first rectangular base frame and at least one shear panel is connected in parallel with a second side of the first rectangular base frame oriented perpendicularly to the first side;

a first floor frame including a first cross member, a second set of columns, and a third set of columns, the first cross member supported at each end by a different column from the second set, a different column from the third set disposed at each end of the first cross member above a second column;

a first rectangular floor connected to the first rectangular base frame and the first cross member; and a first rectangular ceiling connected to the first assembly and to the third set of columns of the first floor frame, wherein:

the set of shear panels and the first assembly, without the first interior assembly, provide shear support sufficient for the structure.

Embodiment 2 includes the structure of embodiment 1, wherein:

the set of shear panels connected to the structure includes each shear panel of the set of shear panels connecting the first rectangular base frame to the first rectangular upper frame.

Embodiment 3 includes the structure of embodiment 1, wherein the first interior assembly includes:

four inner walls; and mechanical, electrical, or plumbing elements within an inner space of the first interior assembly with a first element passing from the inner space and through a first inner wall and with a second element passing from the inner space and through a second inner wall, the structure further comprising:

a first outer wall panel associated with the first inner wall; and a second outer wall panel associated with the second inner wall, the first outer wall panel removable to provide access to the first element and the second outer wall panel removable to provide access to the second element.

Embodiment 4 includes the structure of embodiment 3, further comprising a fourth set of columns, a different column from the fourth set provided below each corner of the first rectangular base frame, wherein:

the second set of columns provides a foundation for the first cross member and each column of the second set includes telescoping sections fixed with respect to each other such that the column has a fixed height;

the fourth set of columns provides a foundation for the first assembly and each column of the fourth set includes telescoping sections fixed with respect to each other such that the column has the fixed height.

Embodiment 5 includes the structure of embodiment 3, further comprising a slab providing a foundation for the first assembly, wherein the second set of columns provides a foundation for the first cross member and each column of the second set includes telescoping sections fixed with respect to each other such that the column has a fixed height.

Embodiment 6 includes the structure of embodiment 1, further comprising:

a second assembly connected to the first assembly and including:

a second rectangular base frame identical to the first rectangular base frame;

a second rectangular upper frame identical to the first rectangular upper frame;

a fifth set of columns identical to the first set of columns, each corner of the second rectangular base frame provided with a different column from the fifth set, each column of the fifth set attached to the second rectangular base frame at a base end; and a second interior assembly provided within a second space defined by the second rectangular base frame, the second rectangular upper frame, and the fifth set of columns;

a second floor frame including a second cross member, a sixth set of columns, and a seventh set of columns, the second cross member supported at each end by a different column from the sixth set, a different column from the seventh set disposed at each end of the second cross member above a sixth column;

a second rectangular floor connected to the second rectangular base frame and the second cross member; and a second rectangular ceiling connected to the second assembly and to the seventh set of columns of the second floor frame, wherein:

the set of shear panels and the first assembly and the second assembly, without the first interior assembly and the second interior assembly, provide shear support sufficient for the structure.

Embodiment 7 includes the structure of embodiment 6, wherein:

the set of shear panels connected to the structure includes each shear panel of the set of shear panels connecting either the first rectangular base frame to the first rectangular upper frame, or connecting the second rectangular base frame to the second upper frame.

Embodiment 8 includes the structure of embodiment 6, wherein:

the second assembly is connected to the first assembly such that the first rectangular base frame is adjacent to the second rectangular base frame; and the first rectangular ceiling is oriented in parallel to the second rectangular ceiling or the first rectangular ceiling is oriented perpendicularly to the second rectangular ceiling.

Embodiment 9 includes the structure of embodiment 6, further including:

a third rectangular floor spanning between the first rectangular base frame and the second rectangular base frame, and a third rectangular ceiling spanning between the first rectangular ceiling and the second rectangular ceiling.

Embodiment 10 includes a kit capable of being assembled into a structure, the kit comprising:

a first assembly including:

a first rectangular base frame;

a first rectangular upper frame corresponding to the first rectangular base frame;

a first set of columns, a different column from the first set provided at each corner of the first rectangular base frame, each column of the first set attached to the first rectangular base frame at a base end: and a first interior assembly provided within a first space defined by the first rectangular base frame, the first rectangular upper frame, and the first set of columns;

a set of shear panels;

a first floor frame including a first cross member, a second set of columns, and a third set of columns;

a first rectangular floor connectable to the first rectangular base frame and the first cross member; and a first rectangular ceiling connectable to the first assembly and to the first floor frame, wherein, when the kit is assembled:

at least one shear panel is connected to the structure in parallel with a first side of the first rectangular base frame and at least one shear panel connected in parallel with a second side of the first rectangular base frame oriented perpendicularly to the first side;

the first cross member is supported at each end by a different column from the second set;

a different column from the third set is disposed at each end of the first cross member above a second column;

the first rectangular floor is connected to the first rectangular base frame and the first cross member;

the first rectangular ceiling is connected to the first assembly; and the set of shear panels and the first assembly, without the first interior assembly, provide shear support sufficient for the structure.

Embodiment 11 includes the kit of embodiment 10, wherein, when the kit is assembled:

each shear panel of the set of shear panels is connected to the structure between the first rectangular base frame and the first rectangular upper frame.

Embodiment 12 includes the kit of embodiment 10, wherein the first interior assembly includes:

four inner walls; and mechanical, electrical, or plumbing elements within an inner space of the first interior assembly with a first element passing from the inner space and through a first inner wall and with a second element passing from the inner space and through a second inner wall, the first assembly further comprising:

a first outer wall panel associated with the first inner wall; and a second outer wall panel associated with the second inner wall, the first outer wall panel removable to provide access to the first element and the second outer wall panel removable to provide access to the second element.

Embodiment 13 includes the kit of embodiment 12, further comprising a fourth set of columns, wherein, when the kit is assembled:

a different column from the fourth set is provided below each corner of the first rectangular base frame;

the second set of columns provides a foundation for the first cross member and each column of the second set includes telescoping sections fixed with respect to each other such that the column has a fixed height; and the fourth set of columns provides a foundation for the first assembly and each column of the fourth set includes telescoping sections fixed with respect to each other such that the column has the fixed height.

Embodiment 14 includes the kit of embodiment 12, wherein:

the first assembly is configured to be installed on a slab foundation; and, when the kit is assembled, the second set of columns provides a foundation for the first cross member and each column of the second set includes telescoping sections fixed with respect to each other such that the column has a fixed height.

Embodiment 15 includes the kit of embodiment 10, further comprising:

a second assembly connectable to the first assembly and including:

a second rectangular base frame identical to the first rectangular base frame;

a second rectangular upper frame identical to the first rectangular upper frame;

a fifth set of columns identical to the first set of columns, each corner of the second rectangular base frame provided with a different column from the fifth set, each column of the fifth set attached to the second rectangular base frame at a base end; and a second interior assembly provided within a second space defined by the second rectangular base frame, the second rectangular upper frame, and the fifth set of columns;

a second floor frame including a second cross member, a sixth set of columns, and a seventh set of columns;

a second rectangular floor connectable to the second rectangular base frame and the second cross member; and a second rectangular ceiling connectable to the second assembly and to the seventh set of columns of the second floor frame, wherein, when the kit is assembled:

the second cross member is supported at each end by a different column from the sixth set and a different column from the seventh set is disposed at each end of the second cross member above a sixth column; and the set of shear panels and the first assembly and the second assembly, without the first interior assembly and the second interior assembly, provide shear support sufficient for the structure.

Embodiment 16 includes a method comprising:

assembling a first assembly including:

a first rectangular base frame;

a first rectangular upper frame corresponding to the first rectangular base frame;

a first set of columns, a different column from the first set provided at each corner of the first rectangular base frame, each column of the first set attached to the first rectangular base frame at a base end;

a first interior assembly provided within a first space defined by the first rectangular base frame, the first rectangular upper frame, and the first set of columns; and a set of shear panels connected to the first assembly such that at least one shear panel is connected between the first rectangular upper frame and the first rectangular base in parallel with a first side of the first rectangular base frame and at least one shear panel is between the first rectangular upper frame and the first rectangular base in parallel with a second side of the first rectangular base frame oriented perpendicularly to the first side;

collecting disassembled first structural elements including:

a first floor frame including a first cross member, a second set of columns, and a third set of columns;

a first rectangular floor; and a first rectangular ceiling;

grouping the collected first structural elements as a shipping unit;

shipping the first assembly and the shipping unit to a build site; and assembling the first assembly and the collected first structural elements at the build site such that:

the first cross member is supported at each end by a different column from the second set, with a different column from the third set disposed at each end of the first cross member above a second column;

the first rectangular floor is connected to the first rectangular base frame and the first cross member; and the first rectangular ceiling is connected to the first assembly and to the third set of columns of the first floor frame, wherein:

the set of shear panels and the first assembly, without the first interior assembly, provide shear support sufficient for the assembled structure.

Embodiment 17 includes the method of embodiment 16, wherein each column of the second set of columns includes telescoping sections, the method further comprising:

preparing the build site by:

creating a first set of foundation holes or pads for the second set of columns, and leaving otherwise undisturbed a first area of the site intended to be beneath the first rectangular floor;

installing each column of the second set of columns in a foundation hole or atop a pad of the first set of foundation holes or pads; and fixing the telescoping sections of the second set of columns such that each column of the second set has a fixed height.

Embodiment 18 includes the method of embodiment 17, wherein:

the collecting disassembled first structural elements further includes collecting a fourth set of columns, each column of the fourth set of columns including telescoping sections;

preparing the build site further includes:

creating a second set of foundation holes or pads for the fourth set of columns, and leaving otherwise undisturbed a second area of the site intended to be beneath the first assembly;

the method further includes:

installing the fourth set of columns into the second set of foundation holes or atop the pads; and.

fixing the telescoping sections of the fourth set of columns such that each column of the fourth set has the fixed height.

Embodiment 19 includes the method of embodiment 17, wherein preparing the build site further includes providing a foundation slab on a second area of the site intended to be beneath the first assembly, the foundation slab having the fixed height.

Embodiment 20 includes the method of embodiment 17, further comprising:

assembling a second assembly connectable to the first assembly and including:

a second rectangular base frame identical to the first rectangular base frame;

a second rectangular upper frame identical to the first rectangular upper frame;

a fifth set of columns identical to the first set of columns, a different column of the fifth set provided at each corner of the second rectangular base frame, each column of the fifth set attached to the second rectangular base frame at a base end; and a second interior assembly provided within a second space defined by the second rectangular base frame, the second rectangular upper frame, and the fifth set of columns;

collecting disassembled second structural elements including:

a second floor frame including a second cross member, a sixth set of columns, and a seventh set of columns;

a second rectangular floor connectable to the second rectangular base frame and the second cross member; and a second rectangular ceiling connectable to the second assembly and to the seventh set of columns of the second floor frame, grouping the collected second structural elements with the collected first structural elements as the shipping unit;

shipping the first assembly, the second assembly, and the shipping unit to the build site on a single transport, wherein, wherein, when the kit is assembled:

the second cross member is supported at each end by a different column from the sixth set, a different column from the seventh set disposed at each end of the second cross member above a sixth column; and the set of shear panels and the first assembly and the second assembly, without the first interior assembly and the second interior assembly, provide shear support sufficient for the structure.

The previous description is provided to enable any person skilled in the art to practice the various aspects described herein. In the embodiments, the separation of various system components in the embodiments described above should not be understood as requiring such separation in all embodiments. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

A phrase such as an "aspect" does not imply that such aspect is essential to the subject technology or that such aspect applies to all configurations of the subject technology. 4 disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

At times, for convenience movement and orientations may be referred to as "horizontal" or "vertical," or "up" or "down." One of skill will realize that this is with regard to the apparatus as it is illustrated in the drawing and not with reference to the Earth. All structural and functional equivalents to the elements of the various aspects described throughout this disclosure that are known or later come to be known to those of ordinary skill in the art are expressly incorporated herein by reference and are intended to be encompassed by the claims,

What is claimed is:

1. A structure comprising:

a first assembly including:

a first quadrilateral base frame;

a first set of columns, each corner of the first quadrilateral base frame provided with a different column from the first set of columns, each column of the first set attached to the first quadrilateral base frame at a base end;

a first quadrilateral upper frame, each column of the first set attached to the first quadrilateral upper frame at an upper end; and a set of shear panels, at least one first shear panel from the set being is connected in parallel with a first side of the first quadrilateral base frame and at least one second shear panel from the set being connected in parallel with a second side of the first quadrilateral base frame oriented perpendicularly to the first side;

a first floor frame including a first cross member, a second set of columns, and a third set of columns, the first cross member supported at each end by a different column from the second set, a different column from the third set disposed at each end of the first cross member above a second column;

a first quadrilateral floor connected to between the first quadrilateral base frame and the first cross member; and a first quadrilateral ceiling connected to the first assembly and to the third set of columns of the first floor frame, wherein:

the set of shear panels and the first assembly provide shear support for the structure, and no shear panels are connected to the first quadrilateral floor and the first quadrilateral ceiling external to the first assembly.

2. The structure of claim 1, wherein:

the set of shear panels connected to the structure includes each shear panel of the set of shear panels connecting the first quadrilateral base frame to the first quadrilateral upper frame.

3. The structure of claim 1, the first assembly including a first interior assembly provided within a first space defined by the first quadrilateral base frame, the first quadrilateral upper frame, and the first set of columns, the first interior assembly including:

four inner walls; and a first program element, selected from a group consisting of mechanical element, electrical element, or plumbing element, within an inner space of the first interior assembly and passing from the inner space and through a first inner wall, a second program element, selected from the group, within the inner space and passing from the inner space and through a second inner wall, the structure further comprising:

a first outer wall panel associated with the first inner wall; and a second outer wall panel associated with the second inner wall, the first outer wall panel removable to provide access to the first element and the second outer wall panel removable to provide access to the second element.

4. The structure of claim 3, further comprising a fourth set of columns, a different column from the fourth set provided below each corner of the first quadrilateral base frame, wherein:

the second set of columns provides a foundation for the first cross member and each column of the second set includes telescoping sections fixed with respect to each other such that the column has a fixed height;

the fourth set of columns provides a foundation for the first assembly and each column of the fourth set includes telescoping sections fixed with respect to each other such that the column has the fixed height.

5. The structure of claim 3, further comprising a slab providing a foundation for the first assembly, wherein the second set of columns provides a foundation for the first cross member and each column of the second set includes telescoping sections fixed with respect to each other such that the column has a fixed height.

6. The structure of claim 1, further comprising:

a second assembly connected to the first assembly, the second assembly and including:

a second quadrilateral base frame identical to the first quadrilateral base frame;

a second quadrilateral upper frame identical to the first quadrilateral upper frame; and a fifth set of columns identical to the first set of columns, each corner of the second quadrilateral base frame provided with a different column from the fifth set, each column of the fifth set attached to the second quadrilateral base frame at a base end;

a second floor frame including a second cross member, a sixth set of columns, and a seventh set of columns, the second cross member supported at each end by a different column from the sixth set, a different column from the seventh set disposed at each end of the second cross member above a sixth column;

a second quadrilateral floor connected to the second quadrilateral base frame and the second cross member; and a second quadrilateral ceiling connected to the second assembly and to the seventh set of columns of the second floor frame, wherein:

the set of shear panels and the first assembly and the second assembly provide shear support for the structure.

7. The structure of claim 6, wherein:

the set of shear panels connected to the structure includes each shear panel of the set of shear panels connecting either the first quadrilateral base frame to the first quadrilateral upper frame, or connecting the second quadrilateral base frame to the second upper frame.

8. The structure of claim 6, wherein:

the second assembly is connected to the first assembly such that the first quadrilateral base frame is adjacent to the second quadrilateral base frame; and the first quadrilateral ceiling is oriented in parallel to the second quadrilateral ceiling or the first quadrilateral ceiling is oriented perpendicularly to the second quadrilateral ceiling.

9. The structure of claim 6, further including:

a third quadrilateral floor spanning between the first quadrilateral base frame and the second quadrilateral base frame, and a third quadrilateral ceiling spanning between the first quadrilateral ceiling and the second quadrilateral ceiling.

10. The structure of claim 1, wherein:

the different column from the third set is disposed at each end of the first cross member directly above the second column; and the at least one first shear panel has a horizontal width that is less that a horizontal width of the first side or the second side of the first quadrilateral base frame to which the at least one first shear panel is connected.

11. A kit capable of being assembled into a structure, the kit comprising:

a first assembly including:

a first quadrilateral base frame;

a first set of columns, a different column from the first set provided at each corner of the first quadrilateral base frame, each column of the first set attached to the first quadrilateral base frame at a base end; and a first quadrilateral upper frame, each column of the first set attached to the first quadrilateral upper frame at an upper end;

a set of shear panels;

a first floor frame including a first cross member, a second set of columns, and a third set of columns;

a first quadrilateral floor connectable to the first quadrilateral base frame and the first cross member; and a first quadrilateral ceiling connectable to the first assembly and to the first floor frame, wherein, when the kit is assembled:

at least one first shear panel from the set is connected to the structure in parallel with a first side of the first quadrilateral base frame and at least one second shear panel from the set is connected in parallel with a second side of the first quadrilateral base frame oriented perpendicularly to the first side;

the first cross member is supported at each end by a different column from the second set;

a different column from the third set is disposed at each end of the first cross member above a second column;

the first quadrilateral floor is connected to the first quadrilateral base frame and the first cross member;

the first quadrilateral ceiling is connected to the first assembly; and the set of shear panels and the first assembly provide shear support for the structure, and no shear panels are connected to the first quadrilateral floor and the first quadrilateral ceiling external to the first assembly.

12. The kit of claim 11, wherein, when the kit is assembled:

each shear panel of the set of shear panels is connected to the structure between the first quadrilateral base frame and the first quadrilateral upper frame.

13. The kit of claim 11, the first assembly including a first interior assembly provided within a first space defined by the first quadrilateral base frame, the first quadrilateral upper frame, and the first set of columns, the first interior assembly including:

four inner walls; and a first program element, selected from a group consisting of mechanical element, electrical element, or plumbing element, within an inner space of the first interior assembly and passing from the inner space and through a first inner wall;

a second program element, selected from the group, within the inner space and passing from the inner space and through a second inner wall, the first assembly further comprising:

a first outer wall panel associated with the first inner wall; and a second outer wall panel associated with the second inner wall, the first outer wall panel removable to provide access to the first element and the second outer wall panel removable to provide access to the second element.

14. The kit of claim 13, further comprising a fourth set of columns, wherein, when the kit is assembled:

a different column from the fourth set is provided below each corner of the first quadrilateral base frame;

the second set of columns provides a foundation for the first cross member and each column of the second set includes telescoping sections fixed with respect to each other such that the column has a fixed height; and the fourth set of columns provides a foundation for the first assembly and each column of the fourth set includes telescoping sections fixed with respect to each other such that the column has the fixed height.

15. The kit of claim 13, wherein:

the first assembly is configured to be installed on a slab foundation; and, when the kit is assembled, the second set of columns provides a foundation for the first cross member and each column of the second set includes telescoping sections fixed with respect to each other such that the column has a fixed height.

16. The kit of claim 11, further comprising:

a second assembly connectable to the first assembly, the second assembly including:

a second quadrilateral base frame identical to the first quadrilateral base frame;

a second quadrilateral upper frame identical to the first quadrilateral upper frame; and a fifth set of columns identical to the first set of columns, each corner of the second quadrilateral base frame provided with a different column from the fifth set, each column of the fifth set attached to the second quadrilateral base frame at a base end;

a second floor frame including a second cross member, a sixth set of columns, and a seventh set of columns;

a second quadrilateral floor connectable to the second quadrilateral base frame and the second cross member; and a second quadrilateral ceiling connectable to the second assembly and to the seventh set of columns of the second floor frame, wherein, when the kit is assembled:

the second cross member is supported at each end by a different column from the sixth set and a different column from the seventh set is disposed at each end of the second cross member above a sixth column; and the set of shear panels and the first assembly and the second assembly provide shear support for the structure.

17. The kit of claim 11, wherein, when the kit is assembled:

the different column from the third set is disposed at each end of the first cross member directly above the second column, and the at least one first shear panel has a horizontal width that is less that a horizontal width of the first side or the second side of the first quadrilateral base frame to which the at least one first shear panel is connected.

18. A method comprising:

assembling a first assembly including:

a first quadrilateral base frame;

a first set of columns, a different column from the first set provided at each corner of the first quadrilateral base frame, each column of the first set attached to the first quadrilateral base frame at a base end;

a first quadrilateral upper frame, each column of the first set attached to the first quadrilateral upper frame at an upper end; and a set of shear panels connected to the first assembly such that at least one first shear panel of the set is connected between the first quadrilateral upper frame and the first quadrilateral base in parallel with a first side of the first quadrilateral base frame and at least one second shear panel of the set is connected between the first quadrilateral upper frame and the first quadrilateral base in parallel with a second side of the first quadrilateral base frame oriented perpendicularly to the first side;

collecting disassembled first structural elements including:

a first floor frame including a first cross member, a second set of columns, and a third set of columns;

a first quadrilateral floor; and a first quadrilateral ceiling;

grouping the collected first structural elements as a shipping unit;

shipping the first assembly and the shipping unit to a build site; and assembling the first assembly and the collected first structural elements at the build site such that:

the first cross member is supported at each end by a different column from the second set, with a different column from the third set disposed at each end of the first cross member above a second column;

the first quadrilateral floor is connected to the first quadrilateral base frame and the first cross member; and the first quadrilateral ceiling is connected to the first assembly and to the third set of columns of the first floor frame, wherein:

the set of shear panels and the first assembly provide shear support for the assembled structure, and no shear panels are connected to the first quadrilateral floor and the first quadrilateral ceiling external to the first assembly.

19. The method of claim 18, wherein each column of the second set of columns includes telescoping sections, the method further comprising:

preparing the build site by:

creating a first set of foundation holes or pads for the second set of columns, and leaving otherwise undisturbed a first area of the site intended to be beneath the first quadrilateral floor;

installing each column of the second set of columns in a foundation hole or atop a pad of the first set of foundation holes or pads; and fixing the telescoping sections of the second set of columns such that each column of the second set has a fixed height.

20. The method of claim 19, wherein:

the collecting disassembled first structural elements further includes collecting a fourth set of columns, each column of the fourth set of columns including telescoping sections;

preparing the build site further includes:

creating a second set of foundation holes or pads for the fourth set of columns, and leaving otherwise undisturbed a second area of the site intended to be beneath the first assembly;

the method further includes:

installing the fourth set of columns into the second set of foundation holes or atop the pads; and fixing the telescoping sections of the fourth set of columns such that each column of the fourth set has the fixed height.

21. The method of claim 19, wherein preparing the build site further includes providing a foundation slab on a second area of the site intended to be beneath the first assembly, the foundation slab having the fixed height.

22. The method of claim 19, further comprising:

assembling a second assembly connectable to the first assembly, the second assembly including:

a second quadrilateral base frame identical to the first quadrilateral base frame;

a second quadrilateral upper frame identical to the first quadrilateral upper frame; and a fifth set of columns identical to the first set of columns, a different column of the fifth set provided at each corner of the second quadrilateral base frame, each column of the fifth set attached to the second quadrilateral base frame at a base end;

collecting disassembled second structural elements including:

a second floor frame including a second cross member, a sixth set of columns, and a seventh set of columns;

a second quadrilateral floor connectable to the second quadrilateral base frame and the second cross member; and a second quadrilateral ceiling connectable to the second assembly and to the seventh set of columns of the second floor frame, grouping the collected second structural elements with the collected first structural elements as the shipping unit;

shipping the first assembly, the second assembly, and the shipping unit to the build site on a single transport, wherein, wherein, when the kit is assembled:

the second cross member is supported at each end by a different column from the sixth set, a different column from the seventh set disposed at each end of the second cross member above a sixth column; and the set of shear panels and the first assembly and the second assembly provide shear support sufficient for the structure.

23. The method of claim 19, wherein assembling the first assembly further includes providing the first assembly with:

a first interior assembly provided within a first space defined by the first quadrilateral base frame, the first quadrilateral upper frame, and the first set of columns, the first interior assembly including:

four inner walls; and a first program element, selected from a group consisting of mechanical element, electrical element, or plumbing element, within an inner space of the first interior assembly, and passing from the inner space and through a first inner wall; and a second program element, selected from the group, within the inner space and passing from the inner space and through a second inner wall; the first assembly further comprising:

a first outer wall panel associated with the first inner wall; and a second outer wall panel associated with the second inner wall, wherein the first outer wall panel is removable to provide access to the first element and the second outer wall panel is removable to provide access to the second element.

24. The method of claim 19, wherein, the first assembly and the collected first structural elements are assembled at the build site such that:

the different column from the third set is disposed at each end of the first cross member directly above the second column; and the at least one first shear panel has a horizontal width that is less that a horizontal width of the first side or the second side of the first quadrilateral base frame to which the at least one first shear panel is connected.

* * * * *